US008992393B2

(12) United States Patent
Reyes

(10) Patent No.: US 8,992,393 B2
(45) Date of Patent: Mar. 31, 2015

(54) CHANGE OF DIRECTION MACHINE AND METHOD OF TRAINING THEREFOR

(75) Inventor: Gil Reyes, Las Vegas, NV (US)

(73) Assignee: GRAA Innovations, LLC, Las Vegas, NV (US)

( * ) Notice: Subject to any disclaimer, the term of this patent is extended or adjusted under 35 U.S.C. 154(b) by 0 days.

(21) Appl. No.: 13/385,972

(22) Filed: Mar. 15, 2012

(65) Prior Publication Data

US 2012/0238418 A1 Sep. 20, 2012

Related U.S. Application Data

(63) Continuation-in-part of application No. 12/858,821, filed on Aug. 18, 2010, now Pat. No. 8,663,075.

(60) Provisional application No. 61/348,164, filed on May 25, 2010.

(51) Int. Cl.
*A63B 21/062* (2006.01)
*A63B 21/00* (2006.01)
(Continued)

(52) U.S. Cl.
CPC ..... *A63B 21/023* (2013.01); *A63B 21/08* (2013.01); *A63B 5/00* (2013.01); *A63B 21/0421* (2013.01); *A63B 21/055* (2013.01); *A63B 21/0552* (2013.01); *A63B 21/0615* (2013.01); *A63B 21/062* (2013.01); *A63B 21/0724* (2013.01); *A63B 21/1411* (2013.01); *A63B 21/1476* (2013.01); *A63B 21/1492* (2013.01); *A63B 23/0227* (2013.01); *A63B 23/0405* (2013.01); *A63B 23/047* (2013.01); *A63B 2022/003* (2013.01); *A63B 2023/0411* (2013.01);
(Continued)

(58) Field of Classification Search
USPC ..... 482/97, 121–123, 129, 130, 92–94, 482/98–100, 133–138; D21/673, 692, 693
See application file for complete search history.

(56) References Cited

U.S. PATENT DOCUMENTS 28,066 A 5/1860 Couch
1,139,126 A 5/1915 Kerns
(Continued)

FOREIGN PATENT DOCUMENTS

SU 1335308 A * 9/1987

OTHER PUBLICATIONS

Universal, No. 9450 Centurion DVR Leg Squat Machine, Universal Physical Conditioning Equipment 1985 Catalog, p. 18, 1985.*
(Continued)

*Primary Examiner* — Oren Ginsberg
(74) *Attorney, Agent, or Firm* — One LLP

(57) ABSTRACT

A change of direction machine provides training for various muscles and body structures of a user. In one embodiment, the machine provides focused training for the muscles and body structures associated with making changes in the body's direction. The machine may comprise a pivoting arm assembly supported by a structure. The arm assembly may be configured to provide a resistance such that when a user engages the arm assembly a downward resistance may be applied to the user. The user may engage the arm assembly with his or her upper body and perform training or exercises involving lifting and lowering the user's body, moving laterally, or both. The machine may have various adjustable components to fit a user and to provide the desired resistance to the user.

20 Claims, 24 Drawing Sheets

(51) Int. Cl.

| | |
|---|---|
| ***A63B 21/02*** | (2006.01) |
| ***A63B 21/08*** | (2006.01) |
| ***A63B 21/04*** | (2006.01) |
| ***A63B 21/055*** | (2006.01) |
| ***A63B 21/06*** | (2006.01) |
| ***A63B 23/04*** | (2006.01) |
| *A63B 5/00* | (2006.01) |
| *A63B 21/072* | (2006.01) |
| *A63B 23/02* | (2006.01) |
| *A63B 22/00* | (2006.01) |

(52) U.S. Cl.

CPC ... *A63B2208/0204* (2013.01); *A63B 2225/093* (2013.01); *A63B 21/00065* (2013.01); *A63B 21/00072* (2013.01)

USPC ..... 482/100; 482/98; 482/137

(56) References Cited

U.S. PATENT DOCUMENTS

| | | | | |
|---|---|---|---|---|
| 3,635,472 | A | | 1/1972 | Marcyan |
| 3,638,941 | A | * | 2/1972 | Kulkens ..... 482/113 |
| 3,905,599 | A | | 9/1975 | Mazman |
| 4,208,049 | A | | 6/1980 | Wilson |
| 4,241,913 | A | | 12/1980 | Zwayer et al. |
| 4,275,882 | A | | 6/1981 | Grosser et al. |
| 4,357,011 | A | | 11/1982 | Voris |
| 4,358,107 | A | | 11/1982 | Nissen |
| 5,050,868 | A | | 9/1991 | Pearson |
| 5,058,888 | A | * | 10/1991 | Walker et al. ..... 482/8 |
| 5,072,932 | A | | 12/1991 | Johnson |
| 5,322,492 | A | * | 6/1994 | Pearson ..... 482/129 |
| 5,336,148 | A | * | 8/1994 | Ish, III ..... 482/98 |
| 5,529,558 | A | | 6/1996 | Koenig |
| 5,569,133 | A | | 10/1996 | Vittone |
| 5,702,329 | A | | 12/1997 | Koening |
| 6,251,052 | B1 | * | 6/2001 | Simonson ..... 482/100 |
| 6,336,894 | B1 | | 1/2002 | Kestila |
| 6,561,956 | B1 | | 5/2003 | Allison |
| 6,802,800 | B1 | | 10/2004 | Hobson |
| 7,608,020 | B2 | * | 10/2009 | Mason ..... 482/97 |
| 2006/0100075 | A1 | | 5/2006 | Harsh |
| 2006/0160677 | A1 | | 7/2006 | Piane |
| 2006/0160678 | A1 | | 7/2006 | Franklin |
| 2009/0270231 | A1 | | 10/2009 | Hall et al. |

OTHER PUBLICATIONS

Sorinex, The Hurricane, Power Systems Strength Equipment catalog, model # 50808-6, pp. 20-21, 2007.*

The Super Calf and Squat Machine from www.jumpusa.com, Nov. 21, 2011.

Body-Solid Leverage Squat Calf Machine from www.bodysolid.com, Nov. 21, 2011.

Leverage Squat-Calf Machine from www.powertecfitness.com.

International Search Report and Written Opinion of the International Searching Authority (PCT/US2011/000940).

* cited by examiner

CHANGE OF DIRECTION MACHINE AND METHOD OF TRAINING THEREFOR

This application claims priority to U.S. patent application Ser. No. 12/858,821, filed Aug. 18, 2010, now pending, the disclosure of which is hereby incorporated by reference as if set forth fully herein, and U.S. Provisional Patent Application No. 61/348,164, filed May 25, 2010, the disclosure of which is hereby incorporated by reference as if set forth fully herein.

BACKGROUND OF THE INVENTION

The invention relates to exercise equipment and in particular to a training machine and method therefor.

The squat exercise is an effective and popular exercise for strengthening the lower body, but not well suited for dynamic athletic training. In addition, squats employ an up and down motion which is confined and limiting. Moreover, squats must be carefully performed because the risk of injury is high. This is especially so given that squats are typically performed while carrying weights and the weight is freely supported by the user supporting the weighted bar across the back of the neck and shoulders.

A number of exercise aids have been developed to reduce the risk of injury when performing squats. For example, weights used during squats may be guided by two vertical rails which prevents the weights from moving forward, sideways, backwards, or dropping too far. However, this arrangement suffers from several disadvantages. One such disadvantage is that the vertical rails which support and guide the bar prevent motion of the bar in any direction but straight up and straight down. This creates an un-natural motion for the knee and back, leading to injury or ineffective exercise.

Another solution is to utilize a human spotter on each end of the free bar to grab the weight should the lifter lose balance. While this is one possible solution, it does not prevent injury to the knees and back and is only as good as the spotters themselves. Moreover, a spotter is not always available when lifting and the range of motion for the lifter is still primarily limited to up and down, although leaning forward or backward is possible, which increases the chance of injury.

From the discussion that follows, it will become apparent that the present invention addresses the deficiencies associated with the prior art while providing numerous additional advantages and benefits not contemplated or possible with prior art constructions.

SUMMARY OF THE INVENTION

The change of direction machine disclosed herein provides unique training to strengthen and tone various muscles and body structures of its users. In one or more embodiments, the machine may be directed to the muscles and body structures of the lower body as well as the torso or core of a user. As will be described further below, the machine provides a structure and operation which trains of the muscles and body structures used in changing the direction of one's movement, as well as other muscles and body structures. The machine is highly beneficial in that it can provide resistance to a user for a wide range of user motions. In addition, the machine provides safety and convenience improvements over other exercises and exercise devices.

The change of direction machine may have a variety of configurations. For instance, in one embodiment the machine may be an exercise machine comprising an arm assembly having a pivoting end and an engagement end configured to engage one or more shoulders of a user, a support structure configured to support the arm assembly at the pivoting end. The arm assembly may extend outward from the support structure and be rotatable at the pivoting end relative to the support structure. It is contemplated that the exercise machine may also include a pivot at the pivoting end of the arm assembly. The pivot may be configured to allow the arm assembly to rotate relative to the support structure in a plurality of horizontal and vertical directions. It is noted that the arm assembly may include a locking mechanism configured to engage to lock the arm assembly in position and to disengage to unlock the arm assembly.

A resilient resistance device coupled at a first end to the arm assembly and coupled at a second end to the support structure may be provided to provide a resistance to the user. A tension adjuster movable along a length of the arm assembly may be provided as well. The first end of the resistance device may be coupled to the tension adjuster to allow resistance provided by the arm assembly to be adjusted. The tension adjuster may comprise a ratcheting mechanism configured to move and secure the tension adjuster in place along the length of the arm assembly.

The exercise machine may comprise one or more pads at the engagement end of the arm assembly configured to engage one or more shoulders of the user. The one or more pads are rotatably mounted to the arm assembly at the engagement end. In these cases, one or more range limiters may be at the engagement end of the arm assembly to prevent lateral movement of the one or more pads.

In another embodiment the change of direction machine may be an exercise machine comprising a pivoting arm configured to provide a downward resistance to a user, and a support structure configured to stabilize the exercise machine. The pivoting arm may extend outward from the support structure, and be held at an elevated position by the support structure while being rotatable in a plurality of directions relative to the support structure.

A resilient resistance device having a first end and a second end may be provided to generate a resistance for the user. The first end may be attached to the pivoting arm while the second end may be attached to the support structure. To adjust the tension of the resistance device, a tension adjuster movable along said pivoting arm may be included. The first end of the resilient resistance device may then be attached to said tension adjuster to allow the tension of the resilient resistance device to be adjusted.

Similar to the above embodiment, this exercise machine may comprise one or more pads at an engagement end of the pivoting arm configured to engage an upper body of the user. Alternatively or in addition, the machine may comprise one or more rotating pads at an engagement end of the pivoting arm. The one or more rotating pads may be configured to engage an upper body of the user, while being limited from rotating laterally.

A locking mechanism configured to engage to lock the arm assembly in position and to disengage to unlock the arm assembly may also be provided. It is contemplated that the locking mechanism may comprise a locking member coupled with the pivoting arm and a stop coupled with the support structure. The stop may comprise an open top portion to permit upward movement of the pivoting arm even when the arm assembly is locked.

A method of training a user on a change of direction machine is also disclosed herein. In one embodiment, the method may comprise engaging an engagement end of a pivoting arm assembly at a portion of the user's upper body, lowering the upper body to a lowered position by bending at the knees while resisting the resistance applied to the upper body, and raising the upper body to a raised position by extending at the knees and waist to overcome the resistance applied to the upper body. Lowering and raising the upper body in this manner rotates the pivoting arm assembly in a vertical direction, and may occur without moving the upper body in a forward or backward direction so as to prevent injury. The pivoting arm assembly may be configured to provide a resistance to the user in a downward direction such that the resistance may be applied to the user as the upper body is lowered and raised.

It is noted that a locking mechanism of the pivoting arm assembly may be disengaged to unlock the pivoting arm assembly prior to using the machine. It is also noted that the method may include adjusting the resistance of the machine. Where the resistance is provided by a resistance device attached to a tension adjuster, such adjustment of resistance may occur by moving the tension adjuster along the length of the pivoting arm assembly.

The method may include moving laterally while lowering the upper body. Moving laterally in this manner rotates the pivoting arm assembly in a horizontal direction allowing the resistance to continue to be applied to the user during the lateral motion. The lateral motion may occur in a variety of ways. For example, in one embodiment moving laterally may entail taking a step with a first foot in a lateral direction, moving at least the upper body in the lateral direction while lowering the upper body, and moving a second foot towards the first foot such that the first foot and second foot are adjacent. The user may also move in various lateral directions. For example, the method may comprise moving laterally in a first direction while lowering the upper body one or more times, and moving laterally in a second direction while lowering the upper body one or more additional times. Moving laterally in the first direction and moving laterally in the second direction may accordingly rotate the pivoting arm assembly in a first horizontal direction and a second horizontal direction.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION OF THE PREFERRED EMBODIMENTS

Figure 1A:
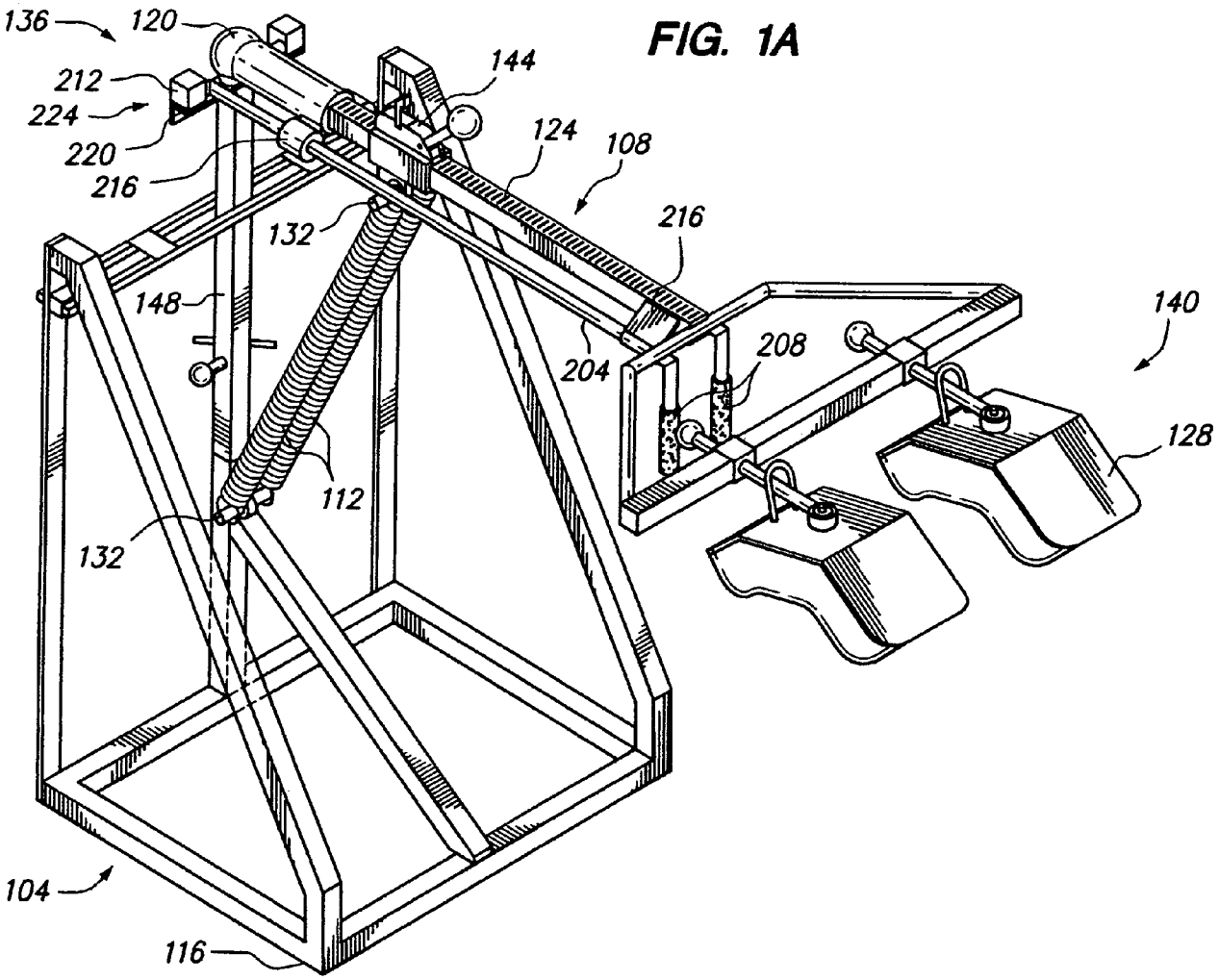
FIG. 1A is a side perspective view of an exemplary change of direction machine.

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, the change of direction machine herein provides a resistance which enhances the effectiveness of squats. The resistance may be applied to a user's upper body like the force provided by weights used with traditional squats. The change of direction machine's resistance is unique however in that it moves with the user's body during squats. In this manner, the change of direction machine conforms to the user's natural body movements. This allows effective training while greatly reducing the risk of injury.

Whereas traditional squats using free weights may be difficult for beginners to perform, the structure and design of the present invention allows even the non-accomplished and non-experienced users to perform weight lifting, and other related or similar exercises, safely and effectively. This is highly advantageous in that it is exceedingly difficult to maintain proper, let alone, perfect form as one becomes fatigued from training during traditional weight lifting exercises. This is especially so with traditional squats with free weights. In addition, as the user becomes fatigued, the risk of injury increases because the user lacks the strength to maintain proper form. Good form and proper performance are more easily and readily attained through use of the present invention, and the user can more readily train for longer periods of time using the present invention.

The change of direction machine may allow hands free operation in one or more embodiments. That is, unlike in traditional squats, the user need not hold one or more weights during training. This reduces fatigue allowing the user to focus his or her energy on lower body training. In addition, the change of direction machine is safer because the risks associated with dropping or falling weights are eliminated. Moreover, the change of direction machine is also more convenient in that the user may perform squats without the need for an assistant or spotter.

For these and other reasons (which are disclosed below), the change of direction machine provides "ergomechanics" which improve the ergonomic comfort and convenience for the user while also providing enhanced training and better results for the user.

In one or more embodiments, the change of direction machine may be configured to allow performance of one or more enhanced squats. In general, the enhanced squats have a much larger range of motion than traditional squats, and have greatly reduced risk of injury. For instance, as will be described further below, the resistance provided by the change of direction machine allows for one or more enhanced squats including a wide range of lateral motions to be performed. The ability to make these motions quickly and with strength is highly beneficial to building lower body muscles as well as to improve speed and agility in sports such as tennis and basketball, among others.

Referring to FIG. 1A, the change of direction machine comprises a support assembly 104 and an arm assembly 108. The support assembly 104 is generally configured to support or hold one or more elements of the change of direction machine. In one or more embodiments, the support assembly 104 may be configured to provide a stable base for the change of direction machine and to position the arm assembly 108 at an elevated position for use.

In one embodiment, the support assembly 104 may comprise a structure to support the elements of the change of direction machine. As can be seen in FIG. 1A for example, the support assembly 104 is configured as a frame 116 which holds the arm assembly 108 and other components of the change of direction machine. As can also be seen, the support assembly 104 is configured to provide a base which holds the arm assembly 108 stably even though the arm assembly extends or cantilevers outward from its attachment point to the base. It is contemplated that the support assembly 104 may be secured to the ground, a wall, or other structure to improve stability if desired.

The arm assembly 108 may be held or supported at various elevations. For example, as shown, the arm assembly 108 is elevated between 5 and 6 feet off the ground. Of course, other heights are possible. In one embodiment, the arm assembly 108 may be at or near % of a user's height. In another embodiment, the arm assembly 108 may be at or near the level of a user's shoulders. The arm assembly 108 may be fixed at a elevation or may be adjusted to be secured at various elevations, as will be described further below.

The support assembly 104 may have a low center of gravity in one or more embodiments to allow the arm assembly 108 to extend therefrom without causing the change of direction machine to tip or become unstable, especially when the machine is in use. In addition, the support assembly may be relatively compact in one or more embodiments. This provides a space around the change of direction machine in which a user can move freely. For example, a user may engage the arm assembly 108 and move around the support assembly 104 without risk of contacting the support assembly while training.

The arm assembly 108 may be configured in a variety of ways. In one embodiment shown in FIG. 1A, and more particularly in FIGS. 2A through 2E, the arm assembly 108 comprises a cantilever 124 attached at a pivoting end 136 to the support assembly 104 by a pivot 120. The user may engage the arm assembly 108 at an engagement end 140 of the arm assembly 108. One or more pads 128 may be at the second end of the arm assembly 108 to allow a user to comfortably engage the arm assembly.

The pivot 120 may be configured to allow the engagement end 140 of the arm assembly 108 to move in a variety of directions. For instance, the arm assembly 108 may be moved horizontally, vertically, or both in one or more embodiments. This is highly advantageous in that it permits a variety of training to be performed on the change of direction machine. For example, a traditional squat may be performed by lifting and lowering the arm assembly 108 vertically. The change of direction machine also allows enhanced squats to be performed. For example, an enhanced squat may be performed by lifting and lowering the arm assembly 108 vertically while also moving in a lateral direction, as will be described further below.

The pivot 120 may be various structures that allow the engagement end 140 of the arm assembly 108 to be moved. In one or more embodiments, the pivot 120 may be configured to allow movement along multiple or any axis. As shown for example, the pivot 120 is configured as a ball joint which allows the arm assembly 108 to be moved along any axis. Alternatively, a universal joint may be used. Of course, other unions may be used. For example, a single axis joint such as a hinge joint may be used in some embodiments. The hinge joint may be rotatably mounted to allow movement along more than one axis. For example, the hinge joint may be coupled to another hinge joint to allow movement along more than one axis.

Figure 8:
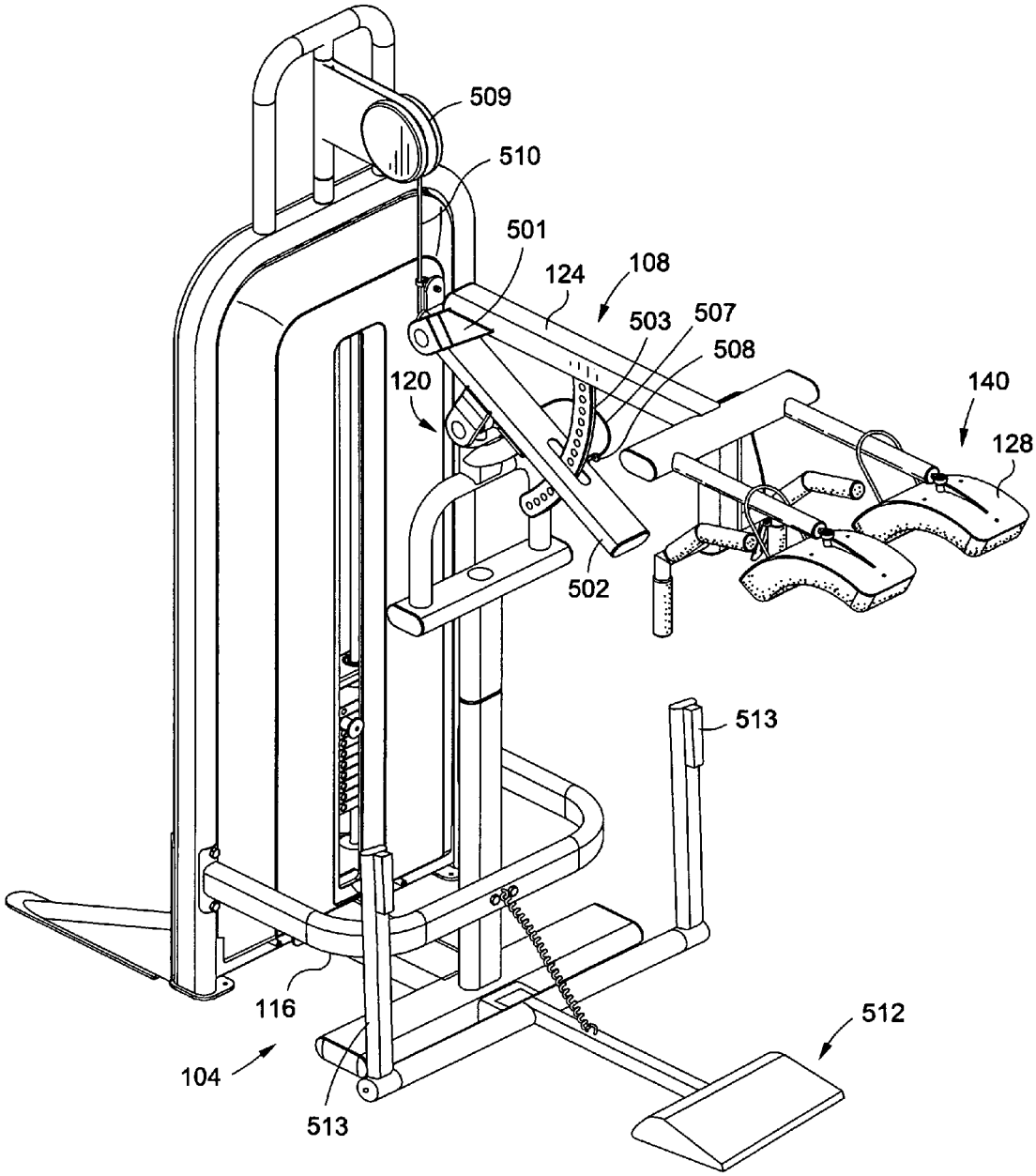
FIG. 8 is a perspective view of an alternate embodiment of a change of direction machine.
Figure 9:
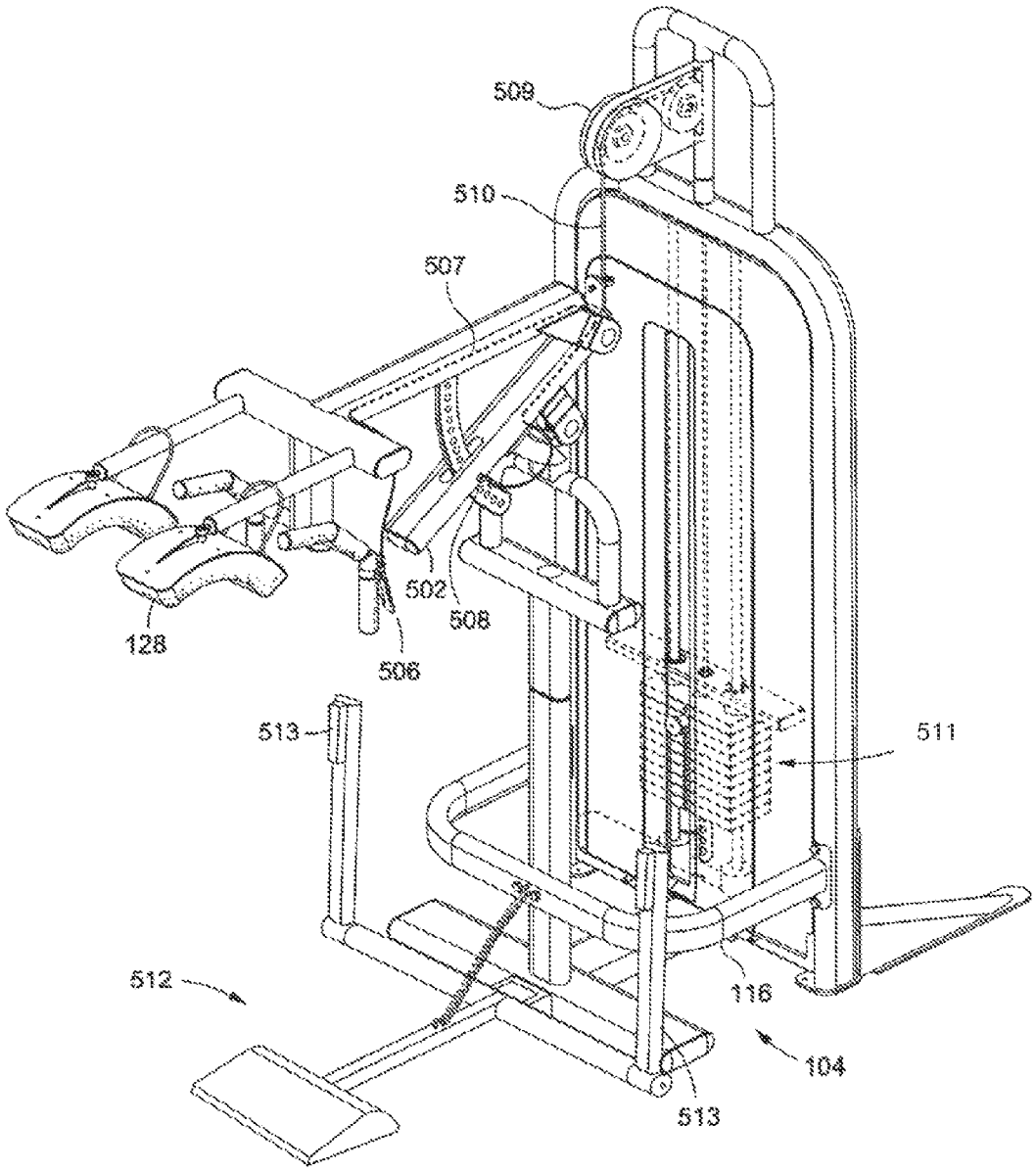
FIG. 9 is a perspective view of an alternate embodiment of a change of direction machine.
Figures 10A, 10B:
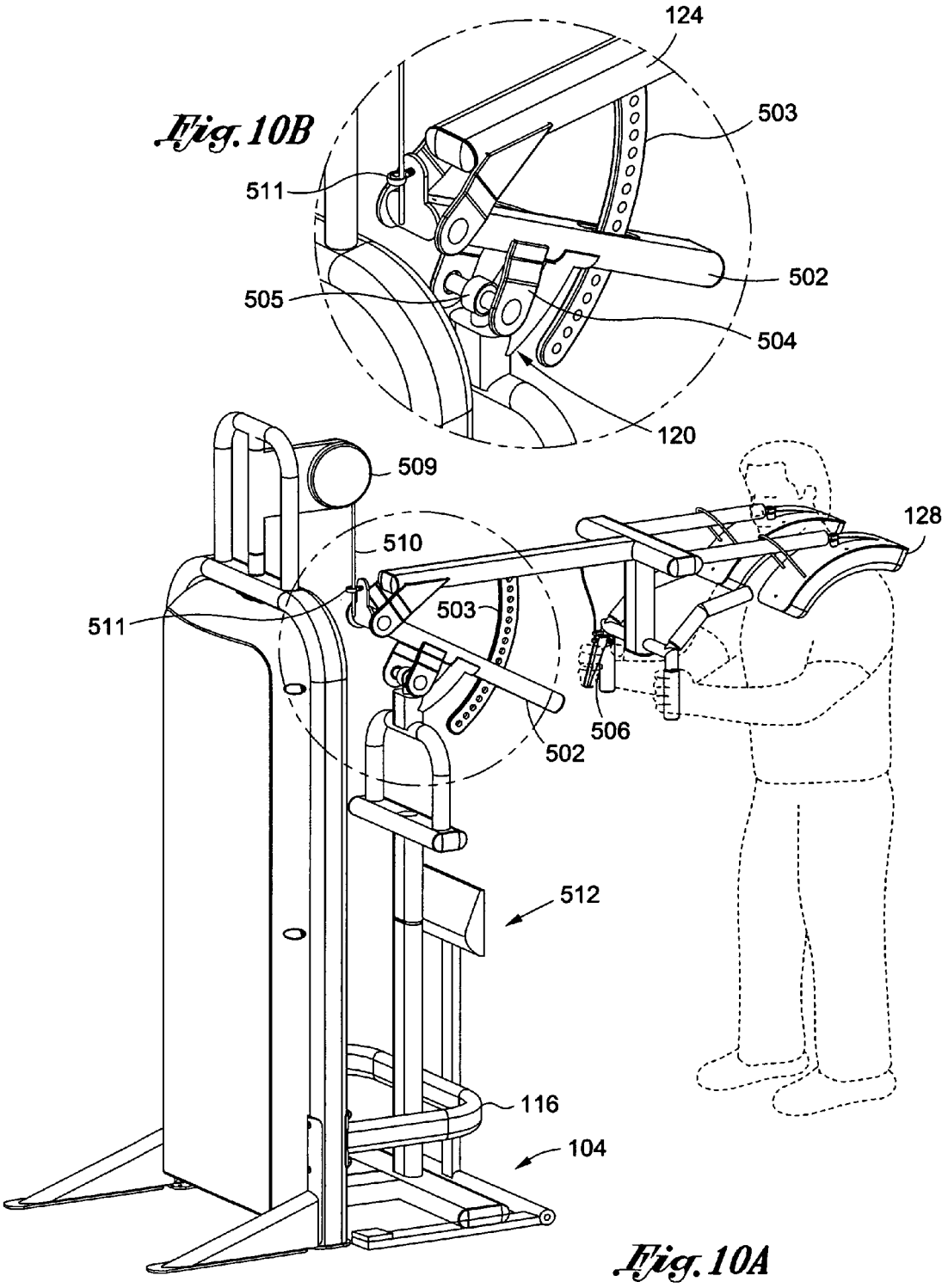
FIG. 10A is a perspective view illustrating exemplary use of an alternate embodiment of a change of direction machine.
FIG. 10B is a perspective view of an alternate embodiment of a pivot and locking mechanism of a change of direction machine.

An alternate embodiment of the arm assembly 108 can be seen on the alternate embodiment change of direction machine shown in FIGS. 8 and 9, for example. Here, arm assembly 108 comprises a cantilever 124 attached to a connector bar 502 by way of a hinge 501 on one end, and adjuster bar 503 on the other end. Connector bar 502 is connected to support assembly 104 by way of a pivot 120, which, in this alternate embodiment, is a hinge joint rotatably mounted to allow movement along more than one axis. The detail of pivot 120 can be seen in FIG. 10A, and more particularly in FIG. 10B. Referring to FIG. 10B, pivot 120 comprises a hinge 504 that is attached to the connector bar 502. Hinge 504 is fitted through the joint 505, which itself can turn or spin along its longitudinal axis. As such, connector bar 502 (and correspondingly, cantilever 124 and assembly arm 108) can be moved in an upward or downward direction as well as laterally in a left to right, or right to left direction.

As can be seen, the position of the pivot 120 on the support assembly 104 may determine the elevation or raised position of the arm assembly 108. For example, as shown in FIG. 1A, the pivot 120 is positioned at the top of the support assembly 104. The position of the pivot 120 on the support assembly 104 may be fixed or adjustable according to various embodiments of the change of direction machine. For example, the pivot 120 may be fixed at the top of the support assembly 104 to give the arm assembly 108 a fixed elevation.

Figure 1B:
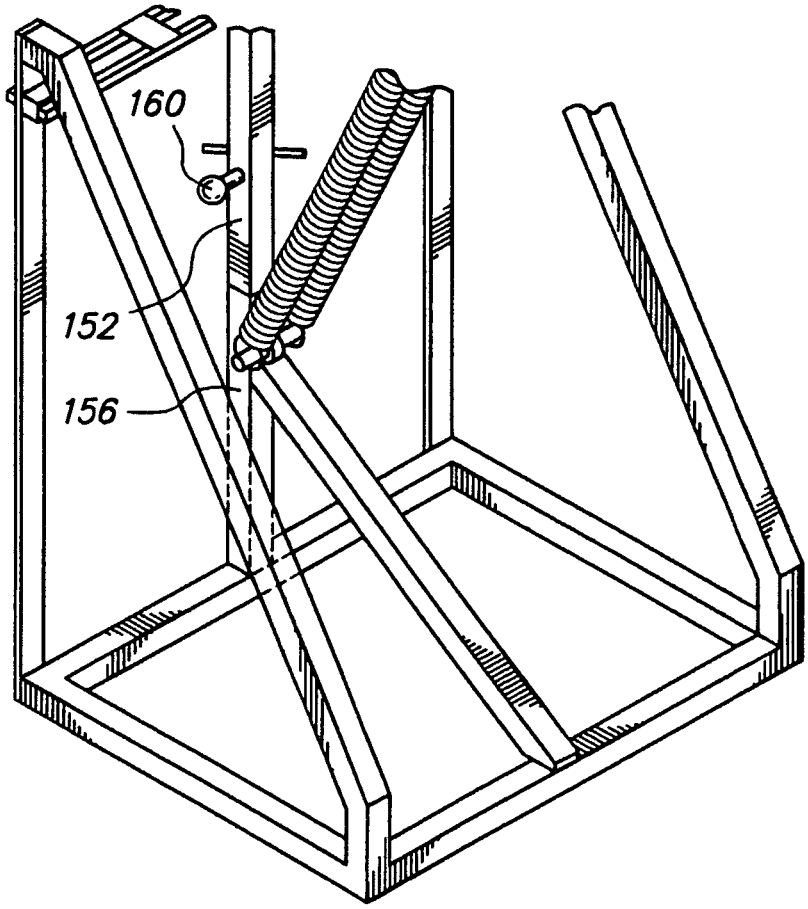
FIG. 1B is a perspective view of an exemplary support structure of a change of direction machine.

Alternatively, the pivot 120 may be configured to be raised and lowered to accordingly raise and lower the arm assembly 108. As shown in FIG. 1A, the pivot 120 may be mounted to a pivot support 148 of the support assembly 104. The pivot support 148 may be raised and lowered in one or more embodiments. It will be understood that this may be accomplished in various ways. For example, in FIG. 1B, the pivot support 148 comprises a sleeve and tube structure where an outer sleeve 152 and inner tube 156 can slide or move relative to one another to lengthen (i.e., raise) and shorten (i.e., lower) the pivot support. Once at the desired height, the sleeve 152 and inner tube 156 may be secured in position relative to one another. For instance, in FIG. 1B, a pin 160 may be inserted through an opening of the sleeve 152 and inner tube 156 to secure them. Of course, the sleeve 152 and inner tube 156 may be secured in other ways in addition to or instead of the pin 160, such as by one or more clips, clamps, screws, or the like.

Alternatively, in the alternative embodiment change of direction machine shown in FIGS. 8 and 9, for example, the height of arm assembly 108 can be adjusted in another manner. Here, referring to FIGS. 9, 10A, and 10B, the height of the cantilever 124 is modified by way of a pin 508 that is fitted through adjuster bar 503. Cable 507 is attached at one end to pin 508, and to handle 506 on the other end (as can be seen more particularly in FIG. 9). When the user applies pressure to handle 506, for example as shown in FIG. 10A, the pin 508 becomes disengaged from the adjuster bar 503, and the user is then able to move cantilever 124 up or down, which correspondingly increases or decreases, respectively, the relative distance between cantilever 124 and connector bar 502, as well as the overall height of arm assembly 108 relative to the ground. Once the desired height of arm assembly 108 is achieved, the user releases the pressure from handle 506, which causes pin 508 to reengage with adjuster bar 508, thus locking arm assembly 108 at the desired height.

The ability for the arm assembly 108 to be raised and lowered is advantageous in that it allows users of various heights to use the change of direction machine. In this manner, the change of direction machine can accommodate taller as well as shorter users. In addition, the arm assembly 108 can be positioned at or near the level of the user's shoulders, whatever that may be, making it easier for the user to engage the machine.

As described and discussed, the arm assembly 108 may comprise a locking mechanism in one or more embodiments. In general, the locking mechanism is used to secure the arm assembly 108 in place when not in use. This is beneficial because the pivot 120 of the arm assembly 108 would otherwise allow the arm assembly to move in a variety of directions. To illustrate, in FIG. 1A, the arm assembly 108 is locked in a substantially horizontal position. This position may be achieved through use of the locking mechanism.

The locking mechanism is beneficial in that it positions the arm assembly 108 in a convenient position. As can be seen in FIG. 1A, the user can easily engage the engagement end 140 of the arm assembly 108 in its locked position. Of course, the locking mechanism may hold the arm assembly 108 in a variety of positions. Typically, the arm assembly 108 will be held substantially horizontal to allow the user to easily engage the arm assembly by stepping into and/or under the pads 128. In this manner, the user may engage the arm assembly 108 without having to first lift the arm assembly.

The locking mechanism may be configured in various ways. In one embodiment, a first portion of the locking mechanism may engage a second portion of the locking mechanism to secure the arm assembly 108 in place. Once engaged, the first portion, second portion, or both may physically hold the arm assembly 108 in place, or may prevent certain movement(s) of the arm assembly.

Figure 2A:
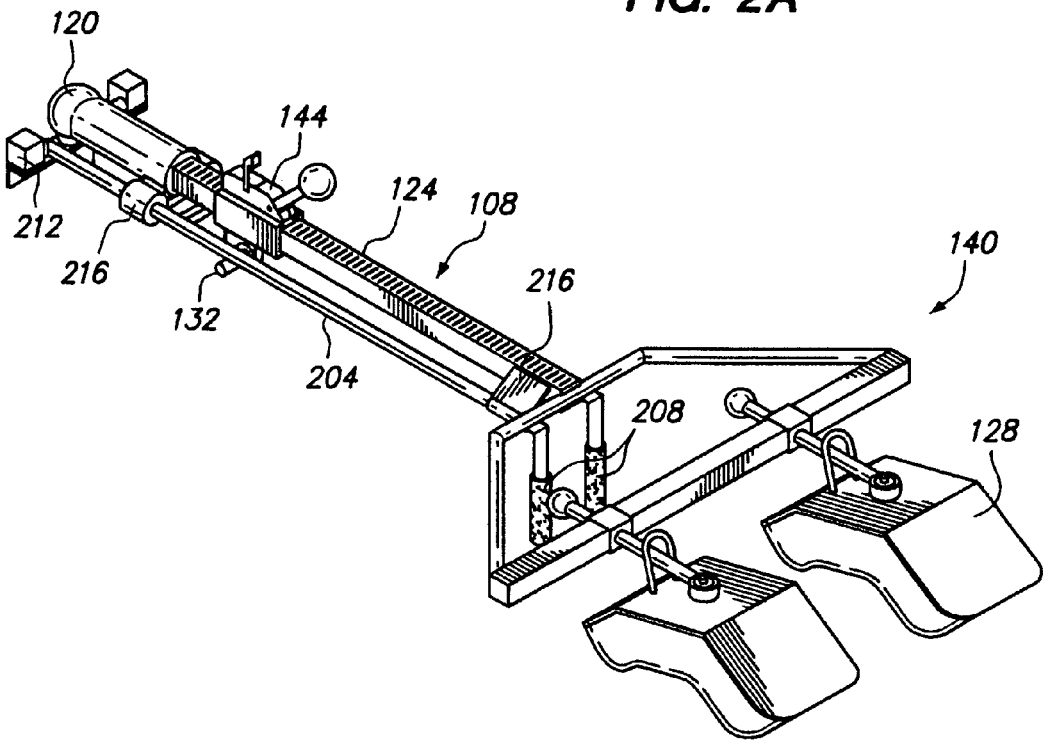
FIG. 2A is a perspective view of an exemplary arm assembly of a change of direction machine.

Exemplary locking mechanisms are illustrated in FIGS. 2A-2E. FIG. 2A is a perspective view of the arm assembly 108 showing the locking mechanism. In one or more embodiments, the locking mechanism may comprise a coupler 224. Of course a plurality of couplers 224 may be used. To illustrate, the embodiment shown has two couplers 224 with a coupler on each side of the arm assembly 108. The coupler 224 may comprise two separate structures that engage to secure the arm assembly 108 in place. For example, the coupler 224 may comprise a stop 220 that may be engaged by a locking member 204 to secure an arm assembly 108 in place. When engaged, physical contact between the stop 220 and locking member 204 may prevent undesired movement of the arm assembly 108.

In one or more embodiments, the locking member 204 may be attached to the arm assembly while the stop 220 may be attached to the support assembly 104. In this manner, when engaged, the coupler 224 secures the arm assembly 108 in position relative to the support assembly 104. As can be seen, the locking member 204 is attached to the arm assembly 108 and the stop 220 is attached to the support assembly 104.

Figure 2B:
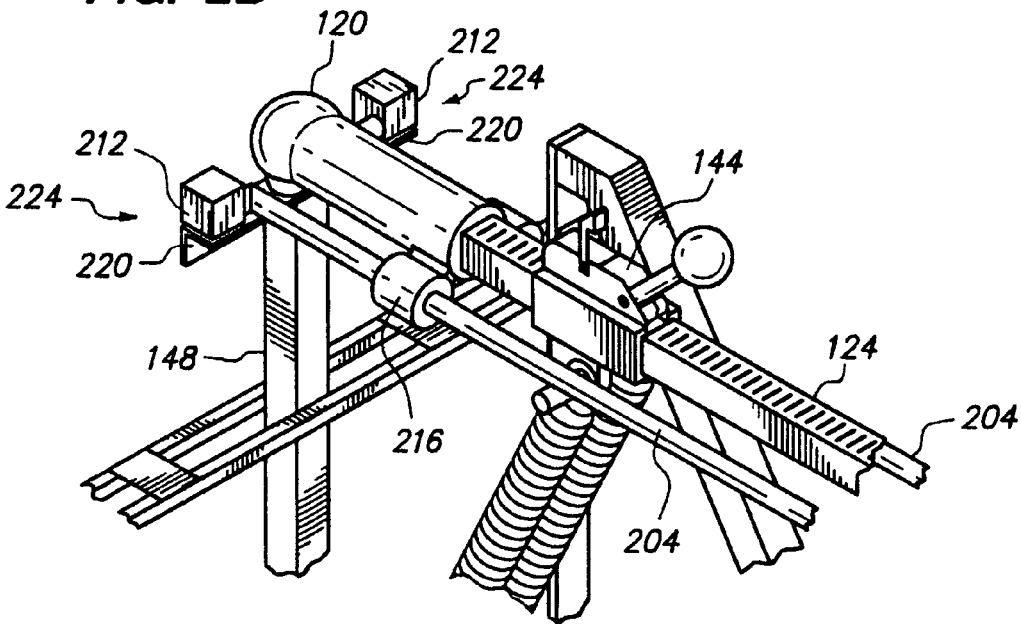
FIG. 2B is a perspective view of an exemplary locking mechanism and tension adjuster of a change of direction machine.

Referring to FIG. 2B, it can be seen that the end 212 of the locking member 204 may have a shaped end in some embodiments. For instance, in FIG. 2B, the end 212 has a square shape at one end. This allows the locking member 204 to engage the planar stop 220 as shown. The planar features of the locking member 204 and stop 220 are in close physical contact when engaged. This limits the motion of the locking member 204 and the stop 220 relative to one another and, in turn, limits the motion of the arm assembly 108.

Of course, the end 212 or other portion of the locking member 204 may be formed in various shapes. For example, the end may be round, flat, rectangular, polygonal, or other shapes. The stop 220 may have a corresponding shape to accept or engage the locking member 204. For example, the stop 220 may be curved or comprise a round opening to accept or engage a round locking member to hold the arm assembly 108 in position.

It is noted that the coupler 224 may allow some upward movement of the arm assembly 108 even when the coupler is engaged. This is beneficial in that it allows a user to engage the engagement end 140 of the arm assembly 108 and stand up straight without having to first unlock the arm assembly by disengaging the coupler 224. To illustrate, in FIG. 2B, the stop 220 is configured as a shelf-like structure with an open area above. In this manner, the stop 220 prevents the arm assembly 108 (when locked) from moving downward, but allows at least some upward movement. This allows the user to stand up straight and brace him or herself to hold the arm assembly 108 before the arm assembly is unlocked.

Figure 2C:
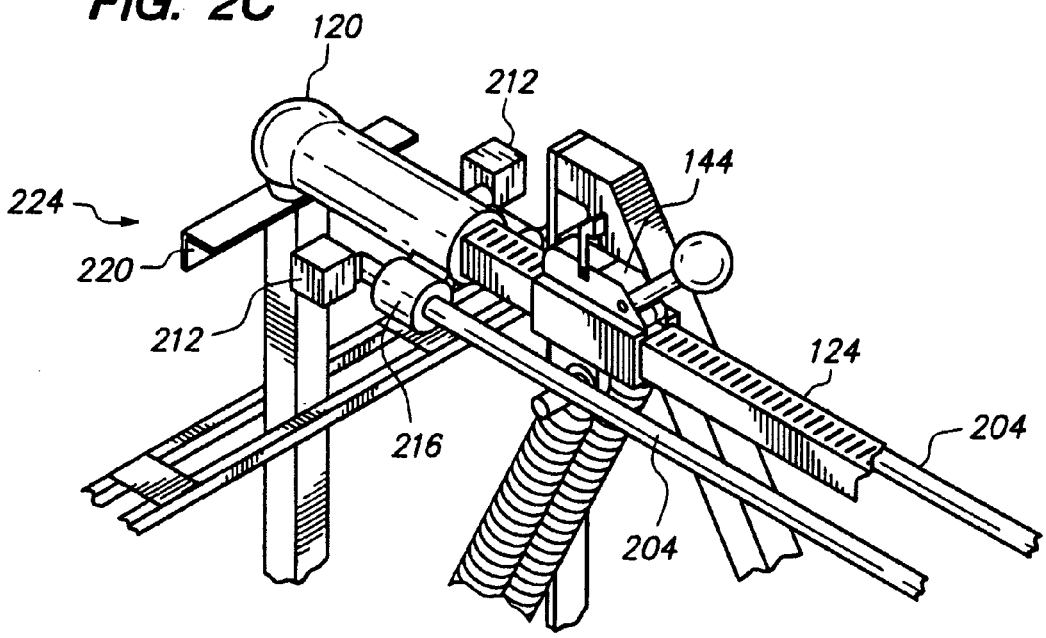
FIG. 2C is a perspective view of an exemplary locking mechanism and tension adjuster of a change of direction machine.

The locking member 204 of the coupler 224 may be movable so as to allow the locking member to engage and disengage the stop 220. This may be achieved by one or more mounts 216 that allow the locking member 204 to move to engage and disengage the stop 220. As shown in FIG. 2B, the mount 216 comprises an open structure which allows the locking member 204 to slide or move within the mount to engage and disengage the stop 220. In FIG. 2B, the locking member 204 and stop 220 have been engaged. As FIG. 2C shows, to disengage the stop 220, the locking member 204 may be slid or otherwise moved away from the stop, releasing the arm assembly 108. It will be understood that the mount 216 may be configured as various guides, tracks, and the like to allow the locking member 204 to engage and disengage the stop 220.

Referring back to FIG. 2A, the locking mechanism may provide one or more handles 208 to allow the user to more easily use the locking mechanism. It is noted that handles 208 may not be present in all embodiments because the user may directly engage the locking mechanism. If included, the handles 208 may be attached to the locking members 204 such that they are located near or at the engagement end 140 of the arm assembly 108 to allow the user to conveniently access the handles. The locking members 204 may be elongated in one or more embodiments, to allow the handles 208 to be located near the user.

In operation, the user may grasp the handles 208 and move the locking members 204 to engage the stop 220 (as shown in FIG. 2C) to lock the arm assembly 108 in position. To release the arm assembly 108, the user may grasp the handles 208 and move the locking members 204 to disengage the stop 220 (such as shown in FIG. 2C). For example, in the illustrated embodiment, the user may grasp the handles 208 and slide the locking members 204 forward to engage the stop 220 and backward to disengage the stop 220. It is noted that then handles 208 may be used for other purposes as well. For instance, a user may grasp the handles during training to further engage the arm assembly 108 as will be described further below.

Figure 2D:
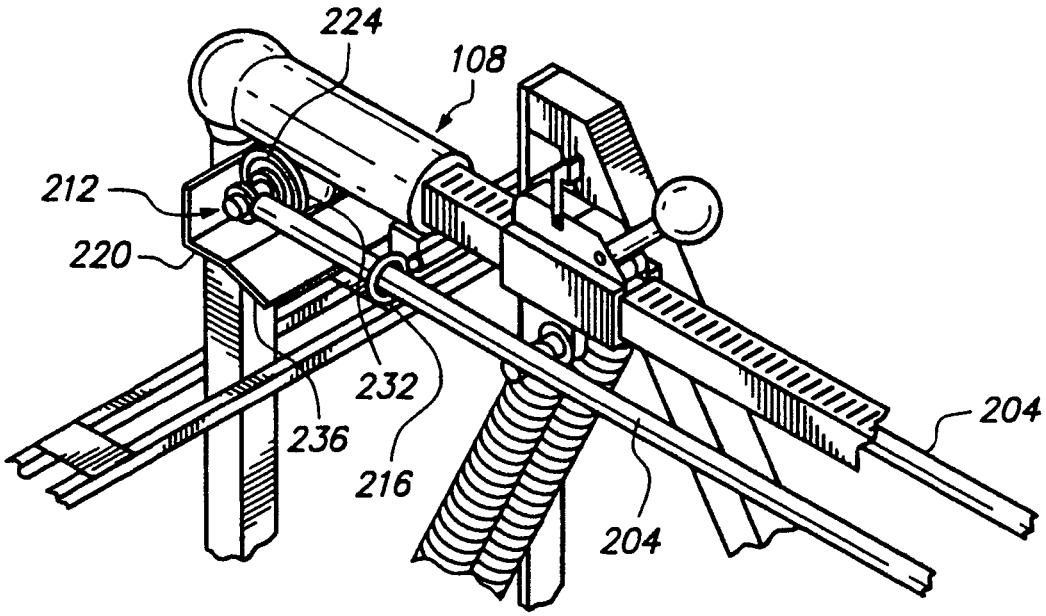
FIG. 2D is a perspective view of an exemplary locking mechanism and tension adjuster of a change of direction machine.
Figure 2E:
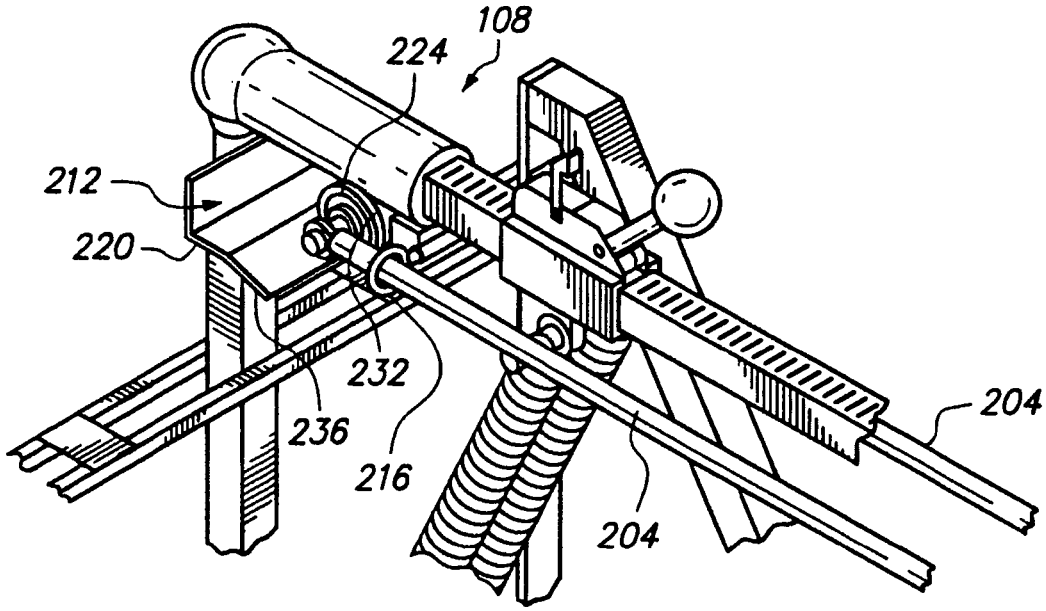
FIG. 2E is a perspective view of an exemplary locking mechanism and tension adjuster of a change of direction machine.

The locking mechanism may have locking members 204 which share a common end 212 in some embodiments. For instance, as shown in FIG. 2D, the locking members 204 are linked at a shared end 212. The end 212 may be configured as discussed above to lock the arm assembly 108 in position. Alternatively, the end 212 may have a rotatable portion which engages a stop 220 to hold the arm assembly 108 in position.

One such embodiment is illustrated in FIG. 2D. As can be seen, the end 212 may comprise a roller 224 which rolls to engage a stop 220. In the embodiment of FIG. 2D the roller 224 wedges itself between the stop 220 and the arm assembly 108 as the locking members 204 are moved to lock the arm assembly in position. The roller 224 is circular in shape and may rotate about an axle. The roller 224 may optionally have one or more grooves, such as shown, to fit tightly between the arm assembly 108 and stop 220. It is contemplated that the roller 224 may be formed from rubber, plastic, wood, metal, or other rigid or semi-rigid material in one or more embodiments. In FIG. 2D for example, the groove 232 in the roller 224 allows the roller to accommodate a rounded portion of the arm assembly 108 adjacent the stop 220.

In one or more embodiments, the stop 220 may have a flange 236 or angled portion, such as shown in FIG. 2D. This is beneficial in that it provides an expanded area for accepting the roller. As can be seen, the flange 236 may be angled downward and/or away from the arm assembly 108 to provide a larger distance between the arm assembly and the stop 220. In this manner, the roller 224 may be guided "into" a tighter or smaller area between the stop 220 and the arm assembly 108 by the flange 236 to lock the roller and thus the arm assembly 108 in position. It is noted that a flange 236 need not be provided in all embodiments as the roller 224 may engage the stop 220 without the flange. In an alternate embodiment, rather than including a flange 236, the stop 220 itself may be angled away from the arm assembly 108.

The roller 224 may be disengaged from the stop 220 by moving the roller away from the stop such as shown in FIG. 2D. As discussed above, this may be accomplished via handles of the locking members 204. Once disengaged the arm assembly 108 may be moved to perform one or more exercises.

In general, the arm assembly 108 provides a resistance to the user's movements during training. This is highly beneficial in that it enhances the strengthening and toning of the user's muscles during training. The resistance may comprise a force applied to the user by the arm assembly 108. The resistance may be directed along various force vectors. Typically, the resistance will be along a downward force vector and may be at various angles. Accordingly, this allows the arm assembly 108 to provide a resistance having a downward force vector to the user.

Figure 7A:
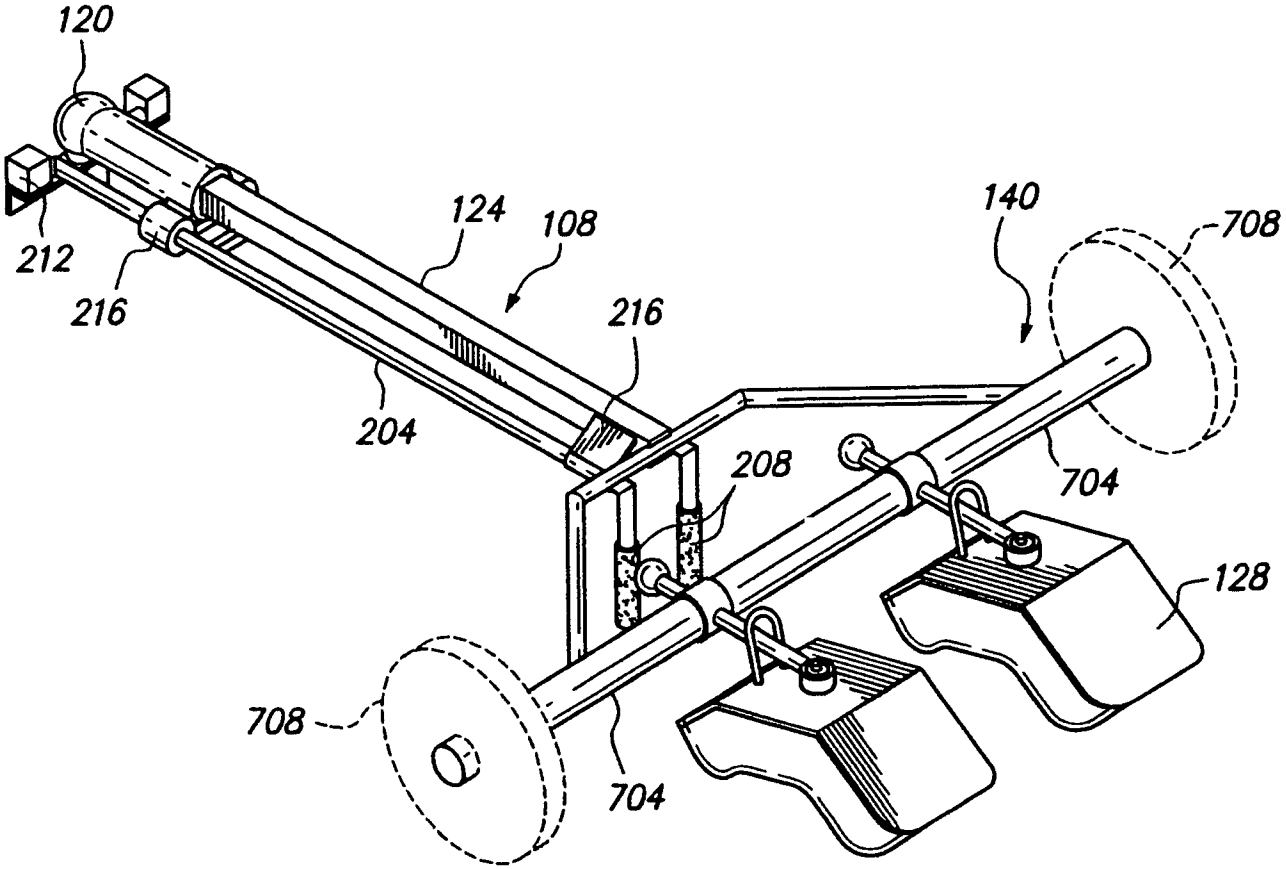
FIG. 7A is a perspective view of an exemplary arm assembly with fixed weights.
Figure 7B:
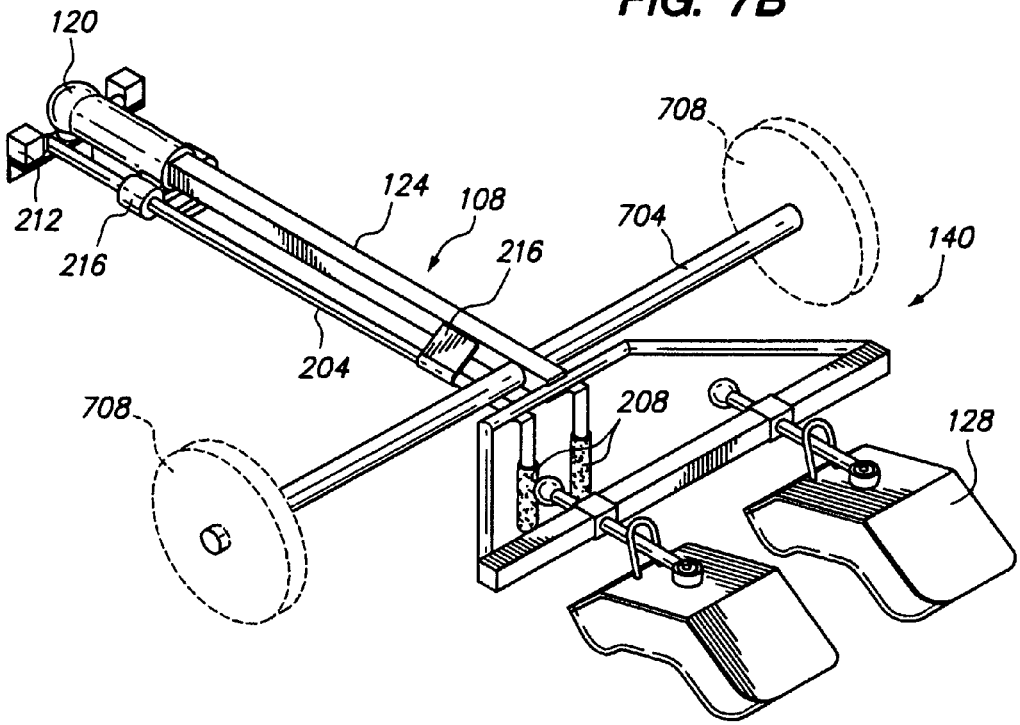
FIG. 7B is a perspective view of an exemplary arm assembly with fixed weights.

Various resistance devices may be used to generate this resistance. In fact, it is contemplated that any device configured to provide a downward force through the arm assembly 108 may be used. For example, one or more weights may be coupled or attached to the arm assembly 108 to provide the downward force, such as shown in FIGS. 7A-7B. As can be seen a support or mount for one or more weights 708 may be used to attach the weights to a portion of the arm assembly 108. For instance, one or more bars 704 or the like may extend from the arm assembly 108 to hold one or more weights 708. As shown, the weights 708 are held at the engagement end 140 of the arm assembly 108, however, it is contemplated that the weights may be at various positions along the arm assembly. It is contemplated that weights 708 may be removed and replaced as desired to provide the desired amount of resistance.

In another example of the alternate embodiment change of direction machine shown in FIGS. 8 and 9, a weight stack or weight stack assembly may be coupled with the arm assembly 108. For example, one or more pulleys may be used to guide a cable of the weight stack to the arm assembly 108 such that a downward force is provided (e.g., the cable approaches the arm assembly from below the arm assembly). Typically, a resistance device will be connected to the arm assembly 108 at the arm assembly's cantilever 124. In the alternate embodiment shown in FIGS. 8 and 9, a cable 510 is attached to one end of connector bar 502 by way of connector 511. Cable 510 runs around pulley 509 and connects to the weight stack assembly 514. It is contemplated that the change of direction machine shown in FIGS. 8 and 9 may be modified to form an alternate embodiment such that free weights may be used instead of a weight stack. This can be accomplished by, for example, the use of bull horns being affixed to either or both sides of a head plate, which is then affixed to the end of cable 510. Free weights, in multiple combinations of weight, may then be hung on (and readily removed from) either or both sides of the head plate in order to create variable resistance.

As can be seen from FIG. 1A, the resistance device may comprise one or more springs 112. As can be seen, the spring 112 may be attached between the arm assembly 108 and the support assembly 104. A first end 132 of the spring 112 may be attached to the cantilever 124 while a second end 132 of the spring may be attached to the support assembly 104 such that the second end 132 of the spring is below the first end 132. In this manner, the spring 112 stretches and thus provides resistance as the arm assembly 108 is moved upward. In other words, the spring 112 provides a downward force through the arm assembly 108. It is noted that though described herein with reference to one or more springs 112, other similar resistance devices may be used in this manner. For example, one or more elastic bands may be used instead or in addition to springs.

Springs 112 (or elastic bands) are beneficial in that they may be used to provide variable resistance. A spring 108 is advantageous because it may provide variable resistance in one or more embodiments. Generally, a variable resistance is one that may increase or decrease as it is moved or stretched. For example, as the spring 112 is stretched, the amount of resistance it provides may increase. In contrast, a fixed resistance, such as a weight, remains constant as it is moved.

A user's strength may vary along a strength curve. For example, the strength of a muscle may increase as it contracts. In addition, the body's skeletal structure contains many fulcrum and lever structures (e.g., arms, legs, and their joints) that can make a resistance more or less easy to move depending on the position of these structures. In contrast to a fixed resistance, a variable resistance, in one or more embodiments, may increase with the body's strength curve. Though this is advantageous, it will be understood that the change of direction machine may be used with fixed resistance devices, such as the weights described above.

The amount of resistance provided may be adjustable in one or more embodiments. Adjustment of resistance may occur in a variety of ways. For example, the user may increase the amount of weight coupled with the arm assembly in some embodiments. In other embodiments, the user may replace one or more springs 112 or elastic bands with other spring(s) or elastic band(s) to adjust resistance. Alternatively or in addition, springs 112 or elastic bands may be added to increase resistance and removed to decrease resistance.

In embodiments using springs 112 or the like, the change of direction machine may include elements or to adjust the resistance provided. For example, the arm assembly 108, support assembly 104, or both may be configured to adjust the resistance. This may occur in a variety of ways. To illustrate, the arm assembly 108, support assembly 104, or both may have components or structures which increase the tension on the change of direction machine's springs 112. In this manner, the amount of resistance provided by the springs 112 is increased. Likewise, the arm assembly 108, support assembly 104, or both may be used to decrease such tension to correspondingly decrease the amount of resistance provided.

For instance, the embodiment of FIG. 1A illustrates an exemplary arm assembly 108 comprising a tension adjuster 144 that may be used to increase or decrease tension on one or more springs 112. In general, the tension adjuster 144 increases tension by elongating the spring 112 and decreases tension by allowing the spring to contract. It is noted that some tension may always be on the spring 112 so that resistance is immediately provided to a user during training.

In one or more embodiments, a spring 112 may provide a substantial force. It is contemplated that several hundred pounds of force may be generated in some embodiments (though other amounts of force may also be generated). In these embodiments, manually adjusting the tension of the spring 112 may be difficult if not impossible. In addition, adjustment of the tension could be dangerous given the forces generated by the spring 112. Therefore, the tension adjuster 144 may be configured to assist a user in adjusting the tension. This is highly beneficial in that it allows easy and safe adjustment of tension. In addition, in some embodiments, tension adjuster 144 may have one or more set locations or positions. This allows the user to set the resistance to a set level consistently. It is contemplated that the tension adjuster 144 may have one or more indicators (e.g., labels) associated with its set positions which indicate how much tension or force would be provided by the change of direction machine if the tension adjuster 144 were moved to a particular position. This is beneficial in that the amount of tension of force may not be readily apparent when using springs 112, elastic bands, or the like.

Figure 3A:
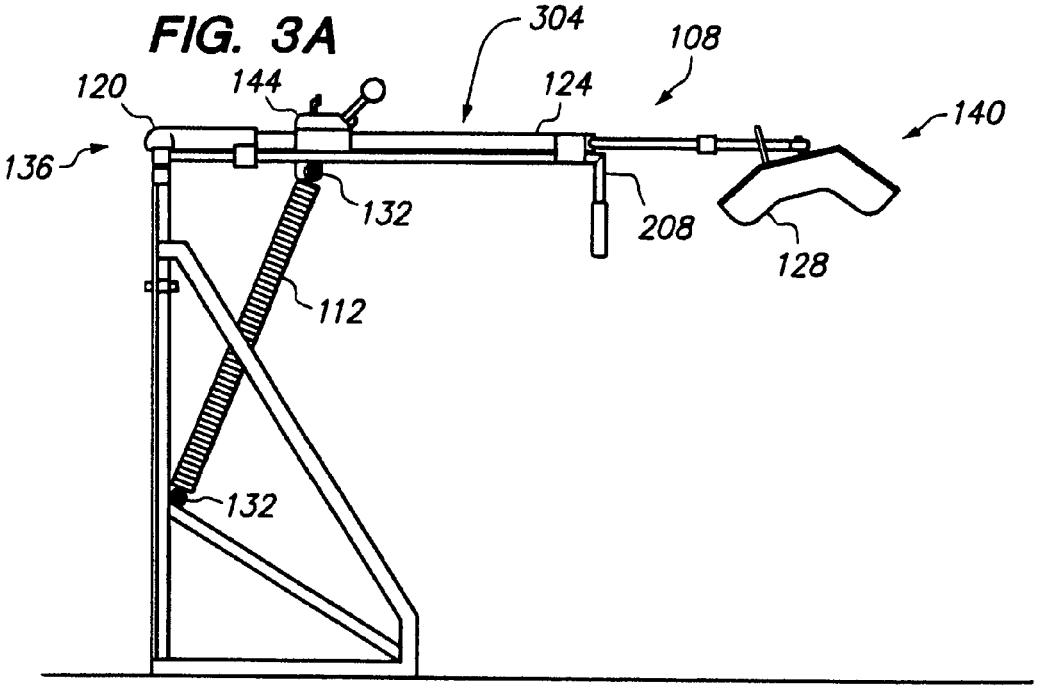
FIG. 3A is a perspective view of an exemplary tension adjuster of a change of direction machine in operation.
Figure 3B:
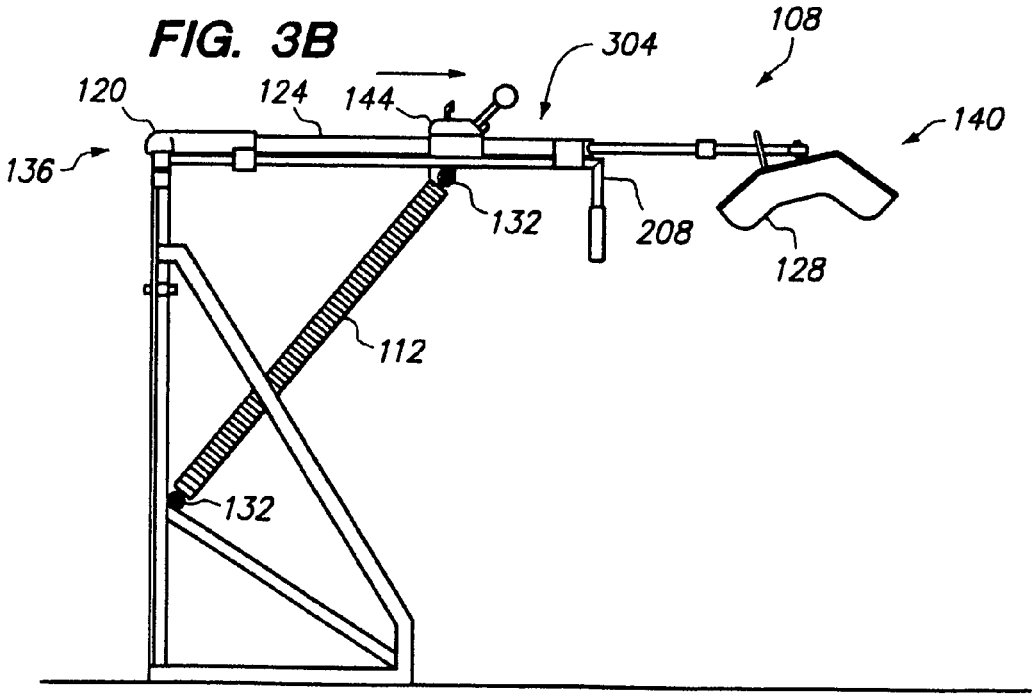
FIG. 3B is a perspective view of an exemplary tension adjuster of a change of direction machine in operation.
Figure 3C:
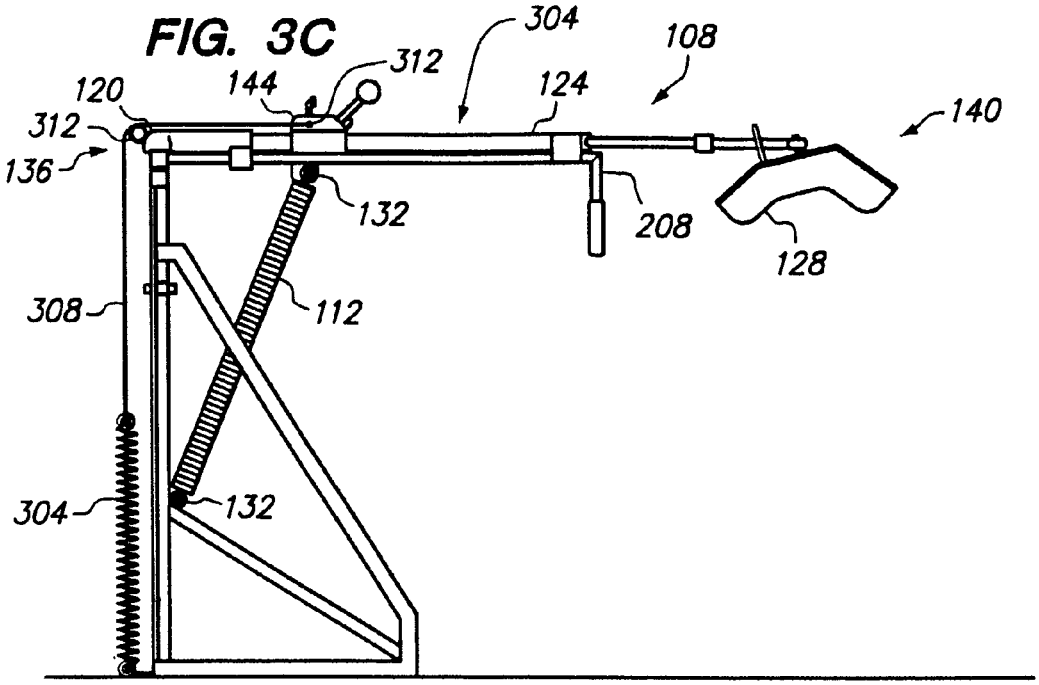
FIG. 3C is a perspective view of an exemplary tension adjuster and return mechanism of a change of direction machine in operation.

In one or more embodiments, the tension adjuster 144 may be movable along the arm assembly 108 to allow tension adjustments of the spring 112 and may be secured in place once the desired tension is achieved. As shown in FIGS. 3A-3D, the tension adjuster 144 may be moved from one position to another to increase or decrease the tension. In FIGS. 3A and 3C, a first tension is provided, while in FIGS. 3B and 3D an increased tension is provided by moving the tension adjuster 144 to increase the tension on the spring. As can be seen, various tensions may be generated by positioning the tension adjuster 144 at various locations along the arm assembly 108.

The tension adjuster 144 may have various configurations. In one or more embodiments, the tension adjuster 144 may comprise a body configured to allow the tension adjuster to move along the arm assembly 108, such as along a track of the arm assembly, and a brake to hold the tension adjuster in position once the desired amount of tension is achieved. To assist in moving the tension adjuster 144, the tension adjuster may comprise a ratcheting mechanism in one or more embodiments. In these embodiments, the ratcheting mechanism may also provide a braking or locking function which holds the tension adjuster 144 in position.

The arm assembly 108 may comprise a track 304 in one or more embodiments. The track 304 may be configured to guide the tension adjuster 144 as the tension adjuster is moved. For example, the track 304 may be an elongated structure between the pivoting end 136 and the engagement end 140 of the arm assembly 108. In this manner, the track 304 allows the tension adjuster 144 to move along the arm assembly 108 between the pivoting end 136 and the engagement end 140. The track 304 may be a separate structure or may be integrally formed with another component of the arm assembly 108. For example, as shown in FIG. 3E, the track 304 has been integrally formed with the cantilever 124 of the arm assembly 108.

The track 304 may also comprise one or more features which allow the tension adjuster 144 to be moved along the track and/or be secured in position. For example, in FIG. 3E, the track comprises a series of indentations 308 that aid in moving the tension adjuster 144 and in securing the tension adjuster in place, as will be described further below. Of course indentations 308 need not be provided in all embodiments. It is contemplated that the tension adjuster 144 may operate on a smooth track 304 in some embodiments. Alternatively, the indentations 308 may be various other structures. For example, the track 304 may comprise a series of openings. The track 304 may also or alternatively include a rough surface to increase friction between the track and the tension adjuster 144. This allows the tension adjuster 144 to have sufficient "traction" to both elongate the springs 112 and be secured in position.

Figure 3D:
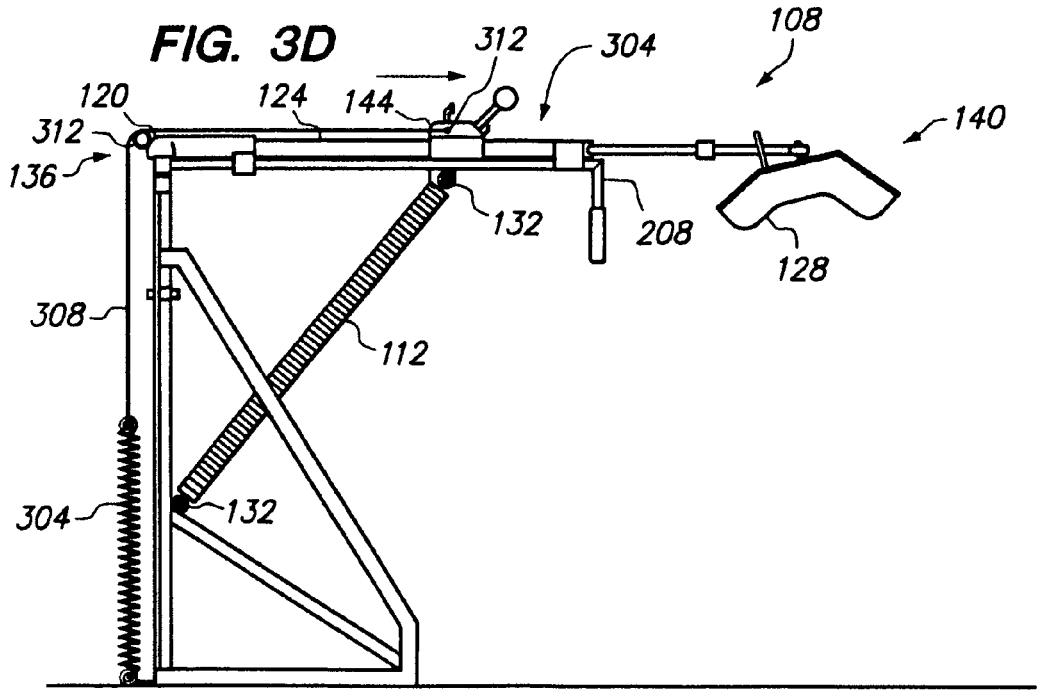
FIG. 3D is a perspective view of an exemplary tension adjuster and return mechanism of a change of direction machine in operation.
Figure 3E:
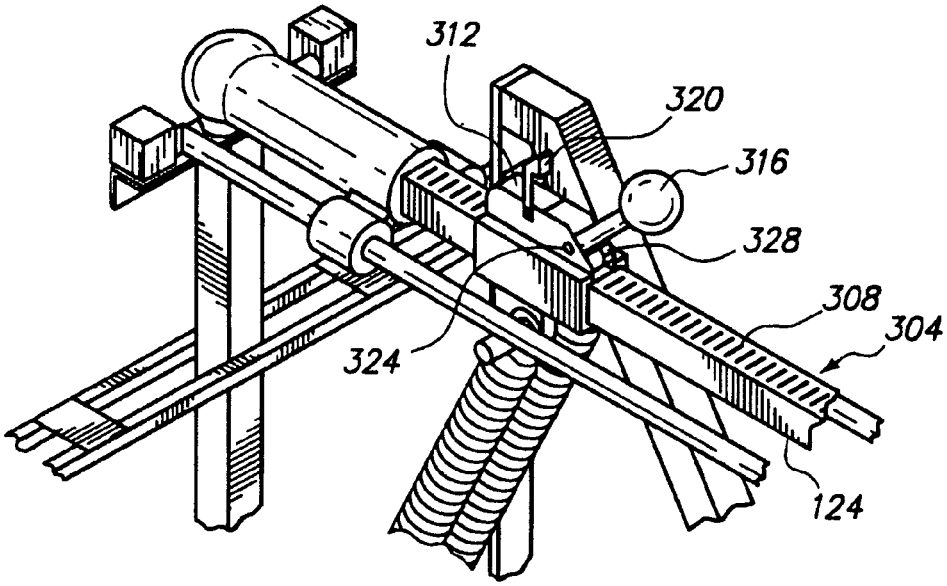
FIG. 3E is a perspective view of an exemplary tension adjuster of a change of direction machine.

FIG. 3E illustrates an embodiment of the tension adjuster 144 comprising a body 312 having a ratcheting mechanism. As can be seen, the body 312 is configured to ride along a track 304 that has been integrally formed into the cantilever 124 of the arm assembly 108. The tension adjuster 144 may include a handle 316 that the user may use to move the tension adjuster. In one or more embodiments, the handle 316 may be coupled with the ratcheting mechanism such that actuating the handle 316 causes the tension adjuster 144 to move.

For example, in FIG. 3E, the handle 316 may be actuated about a pivot 324. This causes a gear or finger of the ratcheting mechanism to engage at least one of the indentations 308 of the track 304. The force applied to the handle 316 may then be transferred via the gear or finger to the track 304 causing the tension adjuster 144 to move. Because the handle 316 may function as a lever, the user's force is amplified thus making it easier (and safer) to move the ratcheting mechanism and adjust the tension on the springs 112.

In one or more embodiments, the handle 316 may be moved to a locking position once the tension adjuster 144 has reached the desired position. In one or more embodiments, placing the handle 316 in the locking position causes the gear or finger to be locked in position relative to the track, thus securing the tension adjuster in position. In FIG. 3E, the handle 316 is illustrated in a locked position. As can be seen, the locked position is one where the handle 316 is pushed (or pulled) forward to engage a stop 328. A release 320 coupled with the ratcheting mechanism may be provided to release the handle 316 from its locked position. For example, actuating the release 320 may release the handle 316 such that the handle may once again be actuated to move the tension adjuster 144.

The ratcheting mechanism may be configured to move the tension adjuster 144 in one direction. For instance, the ratcheting mechanism may be configured to move the tension adjuster 144 away from the pivoting end 136 of the arm assembly 108 in one or more embodiments. The ratcheting mechanism may also be configured to move the tension adjuster in multiple directions. For instance, actuating the handle 316 towards the engagement end 140 of the arm assembly 108 may cause the tension adjuster 144 to move towards the engagement end while actuating the handle towards the pivoting end of the arm assembly causes the tension adjuster to move towards the pivoting end, or vice versa.

In embodiments where the ratcheting assembly is configured to move the tension adjuster 144 in one direction along a track, it is contemplated that an additional ratcheting assembly (oriented in the opposite direction) may be provided to allow movement in the opposite direction. In this manner, a first handle 316 may be actuated to move the tension adjuster 144 in one direction while a second handle may be actuated to move the tension adjuster in the opposite direction. Either or both handles may be move to their respective locked positions to secure the tension adjuster 144 in position.

The tension assembly 144 may move freely in one direction in some embodiments. For example, in some embodiments the tension assembly 144 may "ratchet" towards the engagement end 136 of the arm assembly 108 and be secured in position when the desired tension is achieved. If released from this position, the tension adjuster 144 may then freely move in the opposite direction towards the pivoting end 136 of the arm assembly. This is advantageous because the ratcheting assembly is used to move the tension adjuster 144 in the direction which increases tension on the springs 112.

In addition to the ratcheting mechanism described above, various other mechanisms may be used to move or help move the tension adjuster 144 towards the pivoting end 136 of the arm assembly. This returns the tension adjuster 144 to a position of lowered or low tension. Such return mechanisms may provide a force which pushes or pulls the tension adjuster 144 towards the pivoting end 136. It is contemplated that the return mechanisms may be electrically powered or motorized in one or more embodiments. For example, a gear or other drive mechanism coupled to the tension adjuster 144 may move the tension adjuster when energized or otherwise powered up.

Return mechanisms are beneficial in overcoming friction between the tension adjuster 144 and the track 304 or other portion of the arm assembly. For example, given the downward force applied by the spring 112, it may be difficult to move the tension adjuster 144 toward the pivoting end 136. The force provided by the return mechanisms thus allows the tension adjuster 144 to be easily moved or returned to a position nearer the pivoting end 136 where the force provided by the change of direction machine is lower.

FIGS. 3C-3D illustrate an exemplary return mechanism that may be used to move the tension adjuster 144 towards the pivoting end 136. As can be seen, the return mechanism may comprise one or more resilient members 304 which attach to the tension adjuster 144 via a connector 312. The resilient members 304 may be attached to the top, bottom, or one or both sides of the tension adjuster 144. This attachment or connection between a resilient member 304 and tension adjuster 144 allows the resilient member to apply a force to the tension adjuster which helps move or moves the tension adjuster. The resilient member 304 may be a resiliently stretchable device or material, such as a spring or elastic band.

In one or more embodiments, the resilient member 304 may be attached to the tension adjuster 144 through a cable 308 or other connecting structure. In the case of a cable 308, a pulley 312 or other cable guide (e.g., a channel, hole, or conduit) may be used to guide the cable from the tension adjuster 144 to the resilient member 304. This is beneficial where the tension adjuster 144 and resilient member 304 are at an angle to one another. As seen in FIGS. 3C-3D for example, the pulley 312 directs the cable 308 from the tension adjuster 144 to the resilient member 304 at an angle.

As shown in FIG. 3D, as the tension adjuster 144 is moved away from the pivoting end 136 and towards the engagement end 140, the resilient member 304 may be elongated or stretched. This in turn causes the resilient member 304 to apply a force in the opposite direction that, if not opposed, would return the tension adjuster 144 to a position nearer the pivoting end 136, such as shown in FIG. 3C.

As stated, the tension adjuster 144 may be various structures or devices which allow the amount of force provided by the change of direction machine to be adjusted. Thus, the tension adjuster 144 need not utilize a ratcheting mechanism in all embodiments. For example, the tension adjuster 144 may comprise a body configured to accept a threaded rod of the tension adjuster's track. In this manner, the tension adjuster 144 may be moved by turning the threaded rod. Because the threads of the threaded rod will typically hold the tension adjuster 144 in place, the tension adjuster need not be locked in position through additional actions or structures. Of course, the tension adjuster 144 may be locked in place by one or more clips, clamps, pins, or the like if desired. Alternatively or in addition, the threaded rod may be locked in place to lock the position of the tension adjuster 144. It is contemplated that the threaded rod may be rotated manually or by a motor in one or more embodiments.

Though shown as part of an arm assembly 108, it will be understood that the tension adjuster may be part of the support assembly 104, or other portions of the change of direction machine. For example, the change of direction machine may comprise a tension adjuster and associated track on the support assembly 104. In one embodiment, this tension adjuster elongates the springs by moving one end of the springs downward.

Figure 4A:
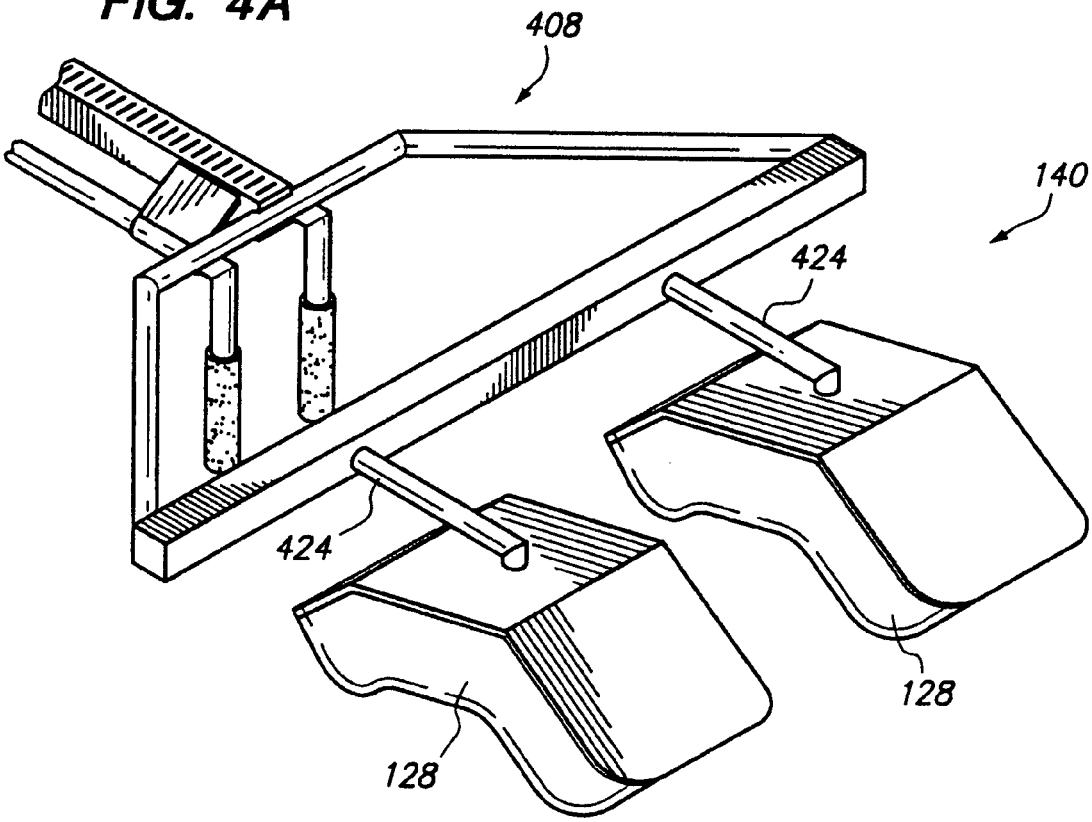
FIG. 4A is a top perspective view of an exemplary engagement end of a arm assembly.

The engagement end 140 of the arm assembly 108 will now be described with regard to FIG. 4A. In general, the engagement end 140 of the arm assembly 108 is configured to accept a user's shoulders during training. In one or more embodiments, the arm assembly 108 may comprise one or more pads 128 to engage the user's shoulders. The pads 128 may be attached to the arm assembly 108 at the engagement end 140 by various structures. For example, the pads 128 may be attached by a support 408. Typically, the support 408 will have a width sufficient to hold the pads 128 apart from one another to engage a user's left and right shoulder. The pads 128 may be mounted rigidly to the support 408 or may be rotatably mounted to the support in one or more embodiments. For instance, as shown in FIG. 4A, the pads 128 have been rigidly mounted to the support 408.

Figure 4B:
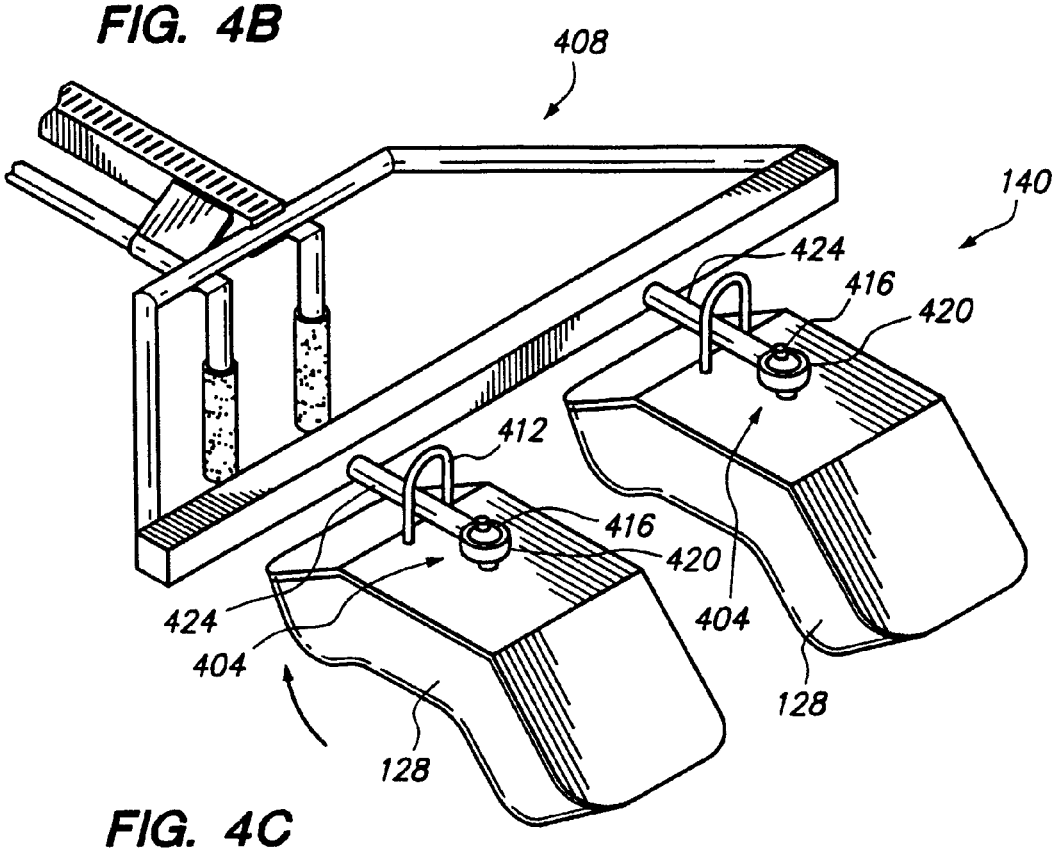
FIG. 4B is a perspective view of an exemplary engagement end of a arm assembly.

FIG. 4B illustrates an embodiment where the pads 128 have been mounted to a rotating or pivoting support. This allows the pads 128 to conform to the motion of the user's shoulders. In addition, the rotation of the pads 128 prevent the pads from pulling the user inward as the arm assembly 108 moves downward. This is especially beneficial where, such as shown, the pads 128 are shaped to curve around the user's shoulders. In addition, this feature allows the pads 128 to hold a user's shoulders and upper body in position such that potentially injury causing forward and backward motions of the upper body are prevented. In this manner, the user may raise and lower his or her upper body in a substantially vertical direction which provides training while greatly reducing the risk of injury. In addition, the rigid structure of the arm assembly 108 helps keep the user's upper body at a fixed distance from the support assembly 104 which also limits forward and backward movement of the user's upper body.

Rotation of the pads 128 may be achieved in a variety of ways. For example, the pads 128 may be mounted to a hinge or a pivot 404 in one or more embodiments. It is contemplated that rotation may be limited to certain directions in some embodiments. For example, if mounted to a hinge, rotation would generally be limited to one direction. Of course, the pads 128 may rotate in any direction in other embodiments. For example, a pivot 404 comprising a universal joint or a ball and socket joint may be used to allow rotation in a variety of directions.

The embodiment of FIG. 4B shows a pad 128 mounted in a rotatable fashion by a pivot 404 and a rotation limiter 412. In general, the pivot 404 rotatably mounts the pad 128 to the support 408 while the rotation limiter 412 prevents the pad from certain movements. In the embodiment shown, the rotation limiter 412 is configured to limit lateral rotation of the pad 128.

The pivot 404 shown comprises a ball 416 and a socket 420. The ball 416 may be attached to the pad 128 while the socket 420 may be attached to the support 408. A support member 424 may be used to attach the socket 420 to the support 408. The support member 424 may be an elongated member, such as shown.

In general, the rotation limiter 412 operates by physically blocking certain movements of the pad 128. For example, in FIG. 4B, the rotation limiter 412 comprises bars which limit the lateral or side-to-side motion of the pad 128 by coming into contact with the support member 424 when the pad rotates laterally. In one or more embodiments, the rotation limiter 412 may loop around the support member 424 such as shown.

As can be seen, though lateral movement is limited, the rotation limiter 412 allows forward and backward rotation of the pad 128. In this manner, the rotation limiter 412 may be thought of as a guide for the forward and backward rotation of the pad 128. The bars of the rotation limiter 412 may be configured such that they do not block the forward and backward rotation of the pad 128. For example, in the embodiment shown, the rotation limiter 412 extends upward from the pad 128 to allow the support member 424 to move up and down freely within the rotation limiter.

Figure 4C:
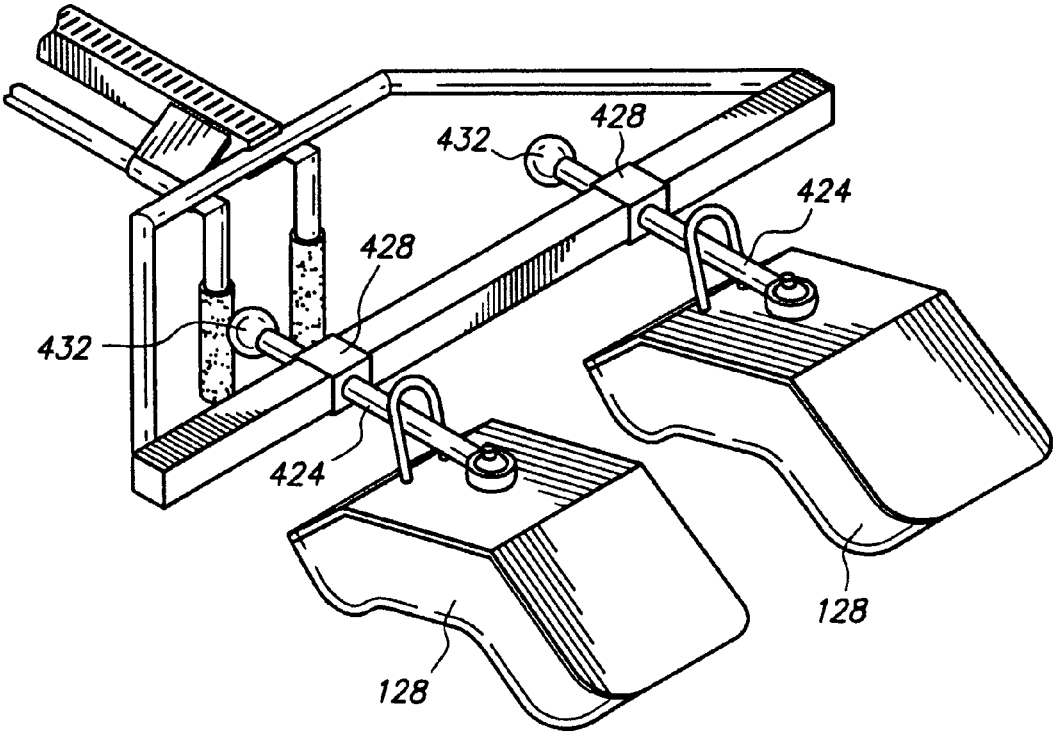
FIG. 4C is a perspective view of an exemplary engagement end of a arm assembly.

In one or more embodiments, the position of the pads 128 relative to the support 408 may be adjustable. FIG. 4C illustrates an embodiment where the pads 128 can be adjusted laterally. In this manner, the pads 128 may be moved closer together or farther apart as desired. This is beneficial in that it allows a variety of users to be accommodated by the pads 128. For example, users with broader shoulders may move the pads 128 away from one another while users with narrower shoulders may move the pads towards one another.

Adjustment of the pads 128 may occur in various ways. In the embodiment shown for example, the pads 128 may be mounted to the support 408 with adjustable support members 424. An adjustable support member 424 may comprise a sleeve 428 which is movable along a member of the support 408. In FIG. 4C, the sleeve 428 is movable along a horizontal member of the support 408. This member is generally perpendicular to the user's shoulders and thus allows the pads 128 to be moved to engage a user's shoulders as desired.

It is contemplated that, once in the desired position, the pads 128 may be secured in position. For example, one or more pins 432 may be inserted into an opening of the sleeve 428 and into the horizontal member of the support 408 to secure the pad 128 in position. As shown, the pins 432 are spring loaded such that they bias towards the horizontal member. In this manner, the pins 432 may automatically insert themselves into an opening of the horizontal member once positioned over such an opening. Of course, other structures or devices may be used to secure the pad 128 in position. For example, the sleeve 428, support member 424, or both may be secured by one or more clips, clamps, screws, or the like.

Figure 4D:
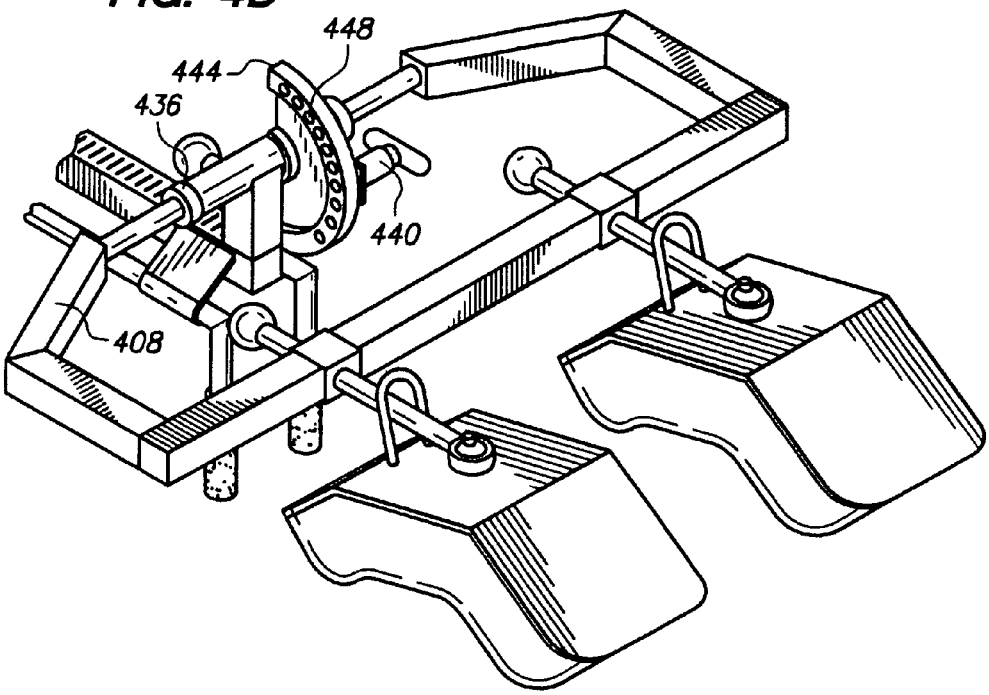
FIG. 4D is a perspective view of an exemplary pivoting engagement end of an arm assembly.

It is contemplated that the engagement end 140 of the arm assembly 108 may be adjustable in one or more embodiments. For instance, as shown in FIG. 4D, the engagement end 140 may pivot upwards or downwards, such as to accommodate various user preferences or to accommodate users of various sizes. Once moved to a desired position, the support 408 of the engagement end 140 may be locked in position for use and unlocked for subsequent readjustment.

A pivoting mount may be used to accomplish such pivoting. The pivoting mount may have various configurations. In FIG. 4D for instance, a rounded portion of the support 408 is held within a sleeve 436 which allows the support 408 to rotate within the sleeve 436. Other structures may be used to accomplish such pivoting. For example, a hinge or the like could be used.

Once pivoted to a desired position, the support 408 may be held in position by one or more clips, clamps, screws, pins, or the like. To reposition the support 408, these items may be released. It is contemplated that other holding mechanisms may be used as well. For instance, FIG. 4D illustrates a pivoting mount for the support 408 including a plate 444 configured to accept a pin 440 to hold the support 408 and thus the engagement end 140 in a desired position.

As can be seen, the plate 444 may have one or more openings 448 to accept the pin 440. The pin 440 may be retractable, spring loaded, or otherwise removable to release the support 408 allowing the support to be positioned. The pin 440 may be reinserted into one of the openings 448 to hold the support 408 in the desired position. The openings 448 may be positioned in a circular arrangement, such as shown, to allow each of the openings to align with the pin 440 when the support 408 is pivoting. The plate 444 itself may have a curved shape or portion so as to avoid colliding with other structures when the support 408 is pivoting.

Figure 4E:
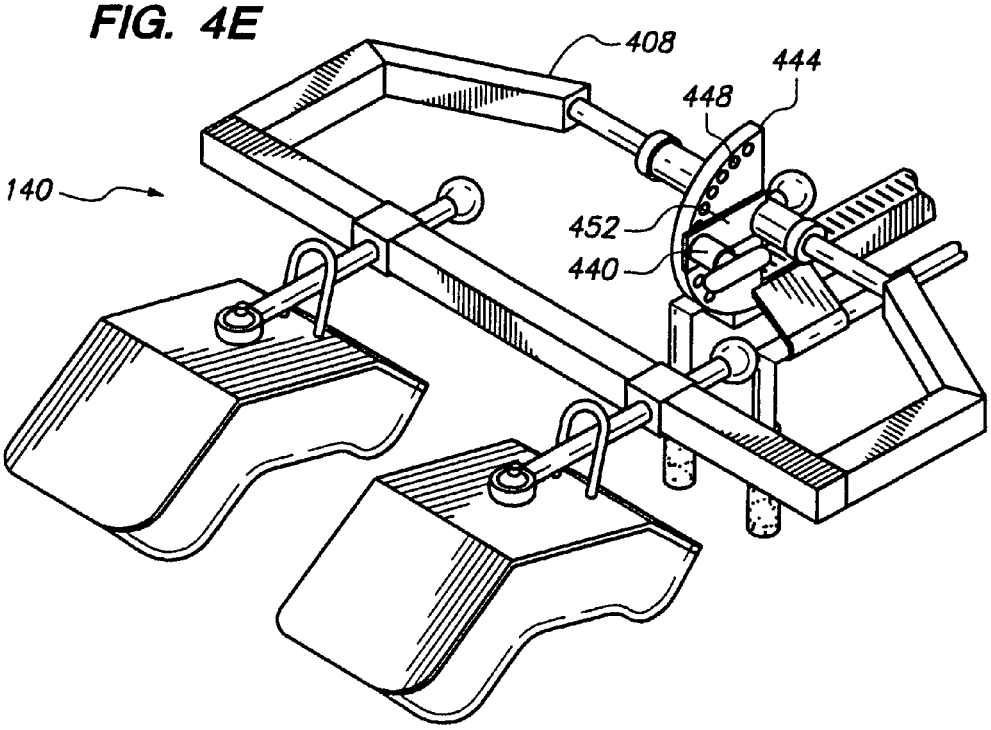
FIG. 4E is a perspective view of an exemplary pivoting engagement end of an arm assembly.

The plate 444 may be attached to the sleeve 436 while the pin 440 is mounted to a portion of the support 408 (or vice versa). In this manner, when the support 408 is pivoted the pin 440 and plate 444 move relative to one another. This allows the pin 440 to be aligned with various of the one or more openings 448 in the plate 444. In this manner, the support 408 may be secured by the pin 440 at a variety of positions by inserting the pin into an aligned opening. As shown in FIG. 4E, the pin 440 may be attached to a mount 452 so as to position (i.e. align) the pin such that it may enter the one or more openings of the plate 444. Of course, a mount 452 is not required where the plate 444 and pin 440 can be properly positioned relative to one another without a mount.

In addition or instead of pivoting, the engagement end 140 may be height adjustable. For instance, the engagement end 140 may be configured such that the support 408 may be raised and lowered as desired and subsequently locked or secured in position. In addition or instead of the capability to pivot, the height adjustability allows the change of direction machine to accommodate users of varying heights. In addition, the height adjustability allows users to set the height of the support 408 according to their own preferences.

Figure 4F:
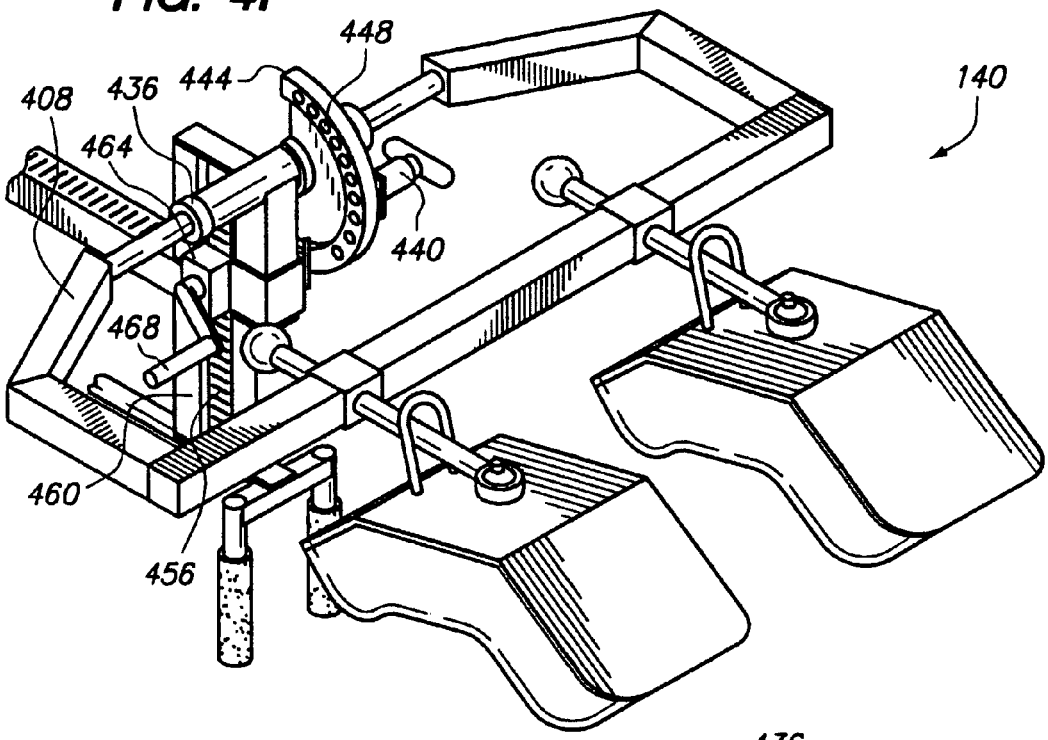
FIG. 4F is a perspective view of an exemplary adjustable engagement end of an arm assembly.
Figure 4G:
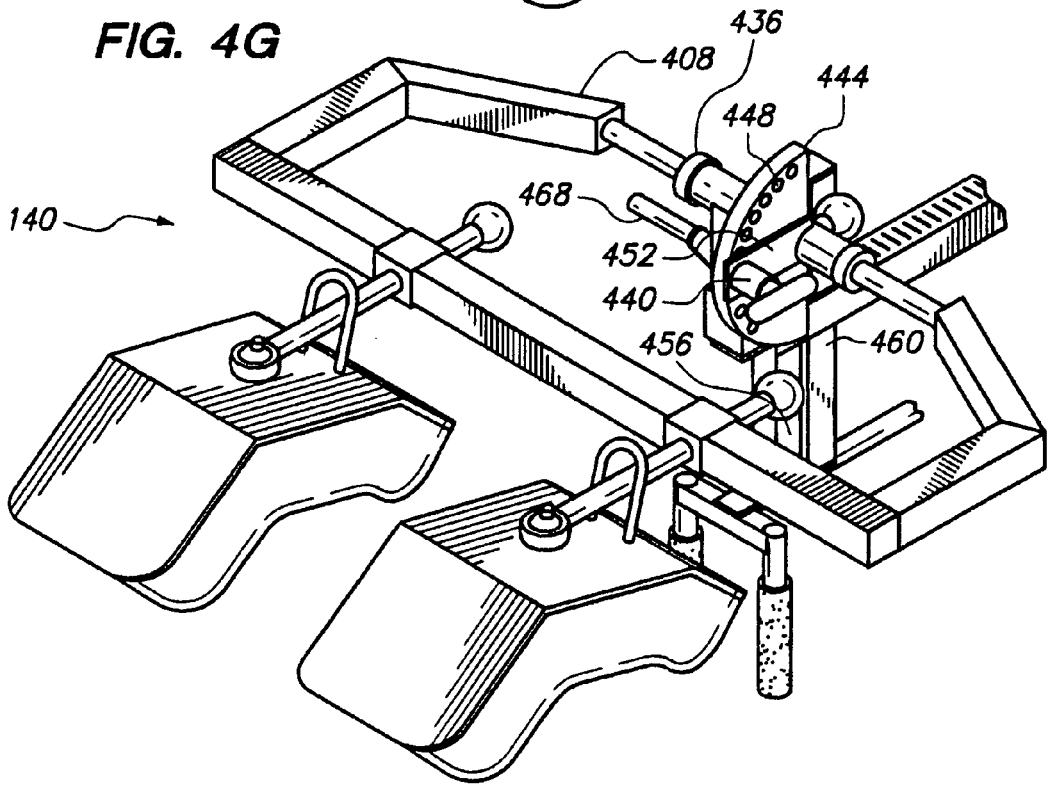
FIG. 4G is a perspective view of an exemplary adjustable engagement end of an arm assembly.

FIGS. 4F-4G illustrate a height adjustment assembly. In general, the height adjustment assembly comprises elements that can hold the support 408 at various elevations. For instance, the height adjustment assembly may comprise an elevating shaft 456 or other member upon which the support 408 may be slideably mounted. In this manner, the support 408 may be raised or lowered to a desired position and then secured in place. Typically, the elevating shaft 456 will be in a substantially vertical or a vertical orientation.

The elevating shaft 456 may be mounted to the arm assembly at the engagement end 140, such as shown in FIGS. 4F-4G. The elevating shaft 456 may be attached to the arm assembly in various ways. In one embodiment, the elevating shaft 456 may be directly attached to the arm assembly. Alternatively, the elevating shaft 456 may be attached via one or more supporting structures. For example, as shown, the elevating shaft 456 is attached to the arm assembly at the engagement end 140 by a brace 460. The elevating shaft 456 may be attached to the brace 460 at its ends in one or more embodiments. This allows a sliding mount to move along the length of the elevating shaft 456 without being encumbered by the brace 460. As can be seen, the brace 460 may be substantially the same length as the elevating shaft 456. The brace 460 may also provide structural reinforcement for the elevating shaft 456 which helps the elevating shaft support the weight of the support 408.

The support 408 may be mounted to the elevating shaft 456 in various ways. In the embodiment shown, the support 408 is also attached to a pivoting mount to allow the support to pivot. It is noted however, that the support 408 may be directly attached to the height adjustment assembly. In such embodiments, the support 408 would be height adjustable but not pivotable.

A sliding mount may be provided to connect the support 408 to the elevating shaft 456 such that the support may move vertically relative to the elevating shaft. In one embodiment, the elevating shaft 456 may function as a track for the sliding mount thereby guiding as well as supporting the sliding mount. To illustrate, in FIGS. 4F-4G, the sliding mount comprises a sleeve 464 which moves along the elevating shaft 456.

It is contemplated that the elevating shaft 456, sliding mount, or both may have features that make it easier for a user to raise and lower the support 408. For example, the elevating shaft 456 may have indentations, protrusions, ridges, or the like on its surface that may be engaged by a gear. In this manner, turning the gear in one direction or another raises or lowers the sliding mount and support 408. The gear may be rotated manually. For example, as shown, the sleeve 464 comprises a handle 468 that allows a user to turn a gear to raise or lower the support 408. The handle 468 may be coupled to the gear by a drive mechanism having its own gears, linkages, or the like. It is noted that the gear may be rotated by a motor in some embodiments.

Once the desired height or elevation for the support 408 is achieved, the support may be held in place. For example, the gear may be locked such that further rotation is prevented. In this manner, the sleeve 464 and support 408 may be secured at a particular height. The gear may be locked in various ways. For example, a component coupled to the gear may prevent further rotation of the gear. To illustrate, the handle or drive mechanism may be held in place thus preventing the gear from rotating.

The support 408 may be secured in place in other ways as well. For example, in FIGS. 4F-4G, it can be seen that a pin may be used to "clamp" or hold the sleeve 464 and support 408 in place. The pin may be mounted to the sleeve 464 in one or more embodiments. In one embodiment, the pin may be threaded and held within a threaded opening of the sleeve 464. The pin may then be turned to cause the pin to move into the sleeve eventually contacting a portion of the elevating shaft 456. The pin may then be tightened onto the elevating shaft 456 to hold the sleeve 464 and support 408 in place. The pin may then be loosened to release the support 408 for further height adjustment.

It is noted that the pin need not be threaded in all embodiments. It is contemplated that the pin may be inserted into or engage a feature of the elevating shaft 456 to hold the support 408 in position. For example, the pin may be inserted into one of a series of openings on the elevating shaft 456. Alternatively, the pin may engage an indentation, ridge, protrusion, or other structural feature of the elevating shaft 456 to hold the support 408 in position. The support 408 may be released for further height adjustment by removing or disengaging the pin from the elevating shaft 456.

Figure 5A:
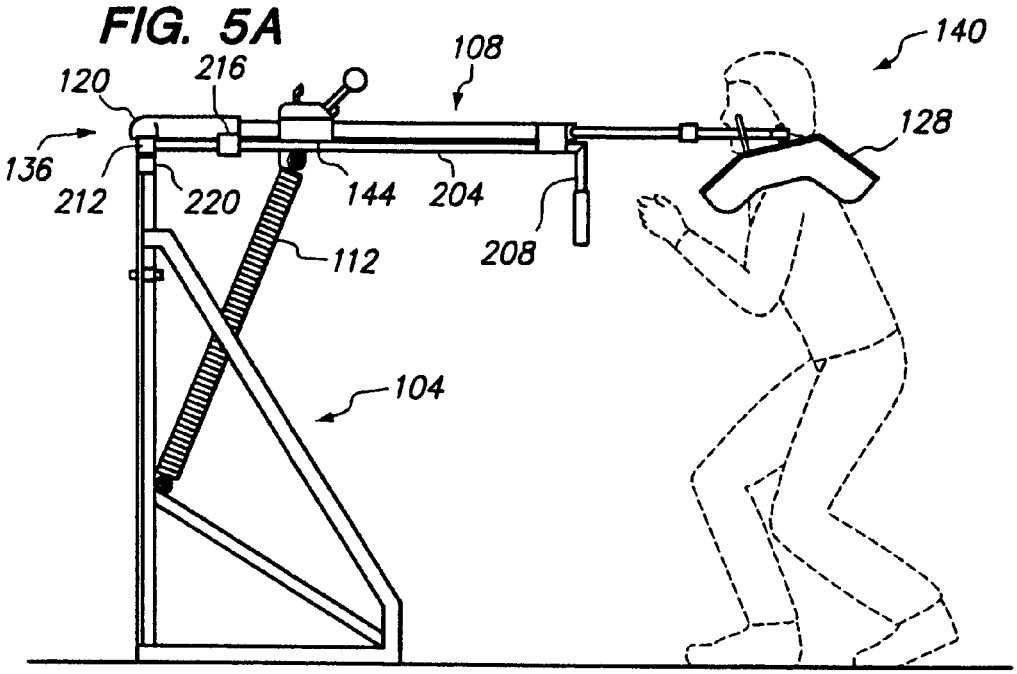
FIGS. 5A-5C are side views illustrating exemplary use of a change of direction machine.

Operation of the change of direction machine will now be described with regard to FIGS. 5A-5C. To begin training, the user may "step into" the change of direction machine such that the user's shoulders engage the pads 128. As can be seen in FIG. 5 A, the arm assembly 108 holds the pads 128 at an elevated position. In one or more embodiments, the pads 128 may be held near or at the level of the user's shoulders. In this manner, the user need only lower his or her shoulders to engage the pads 128. This makes it easier for the user to engage the pads 128 because the user does not have to stoop or bend over an excessive amount. In addition, the user does not have to lift the arm assembly 108 to place the arm assembly on his or her shoulders. This is highly beneficial especially where there is a resistance from the arm assembly 108 that would have to be lifted onto the user's shoulders.

Alternatively, it is contemplated that the user need not lower his or her shoulders to engage the change of direction machine. For example, the user may "step into" the change of direction machine and then lower the arm assembly 108 onto his or her shoulders, such as by unlocking the arm assembly to allow the arm assembly to move downward onto the user's shoulders.

Figure 5B:
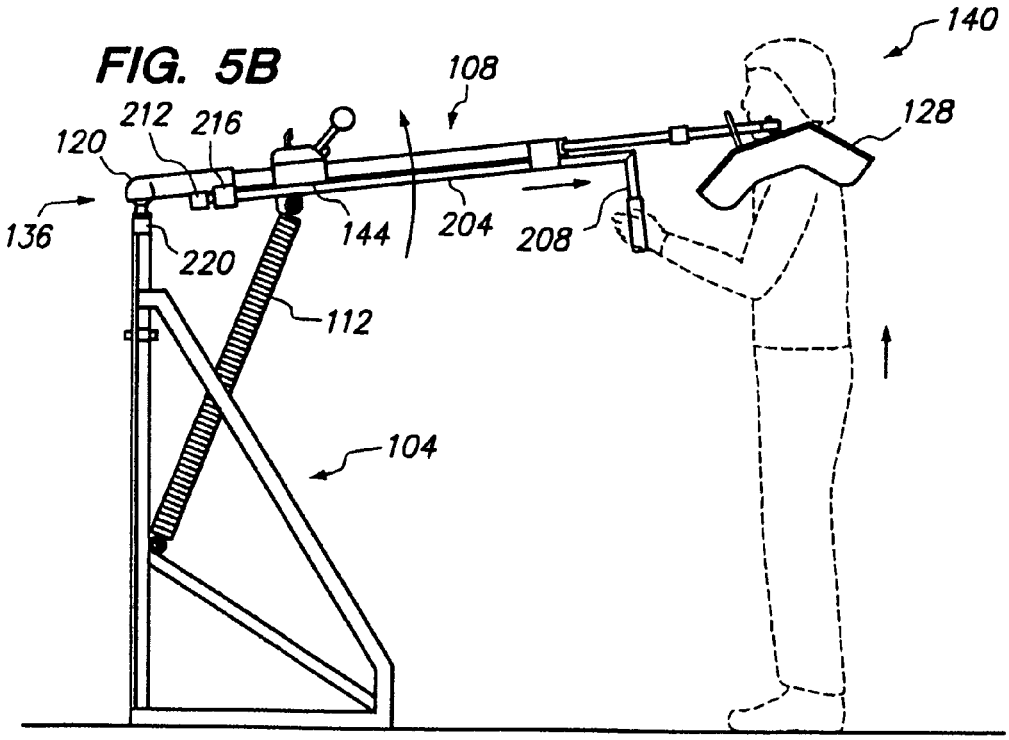

In FIGS. 5B and 10A, the user has "stepped into" the change of direction machine and engaged the arm assembly 108. Such engagement may be achieved by the user engaging one or more pads 128 of the arm assembly 108 by raising his or her shoulders. For example, the user may stand up to engage the one or more pads 128 as shown. As can be seen, the user may cause the arm assembly 108 to lift at least slightly in this position. Also, in this position, the arm assembly 108 elongates the springs 112 (or engages the weight stack assembly 514), and thus resistance is applied to the user via the arm assembly and pads 128. In this manner, resistance is immediately applied to the user and the user continues to experience the resistance during training.

Once the arm assembly 108 is engaged, the user may unlock the arm assembly 108 to allow the arm assembly to move freely. Of course, unlocking is not required where the arm assembly 108 is not locked or does not include a locking mechanism. The arm assembly 108 may be unlocked by disengaging the coupler of a locking mechanism as described above. For example, referring to FIGS. 2A-2B, the user may pull or otherwise move a locking member 204 away from its stop 220 to unlock the arm assembly 108, allowing the assembly to move freely. If handles 208 are provided, the user may move the locking member 204 through the handles.

In the alternative embodiment change of direction machine shown in FIGS. 8 and 9, the user may adjust the height of arm assembly 108 by engaging handle 506, in the manner described in greater detail above.

It is noted that the stop 220, as shown in the devices illustrated in FIG. 5B, may comprise an open top portion. This allows the arm assembly 108 to move upwards even when locked. Thus, as shown in FIG. 5B, when the user stands upright to engage the pads 128, the arm assembly 108 may move upward even though it is locked. This allows the user to engage the arm assembly 108, stand upright, and prepare for training prior to unlocking the arm assembly.

Figure 12:
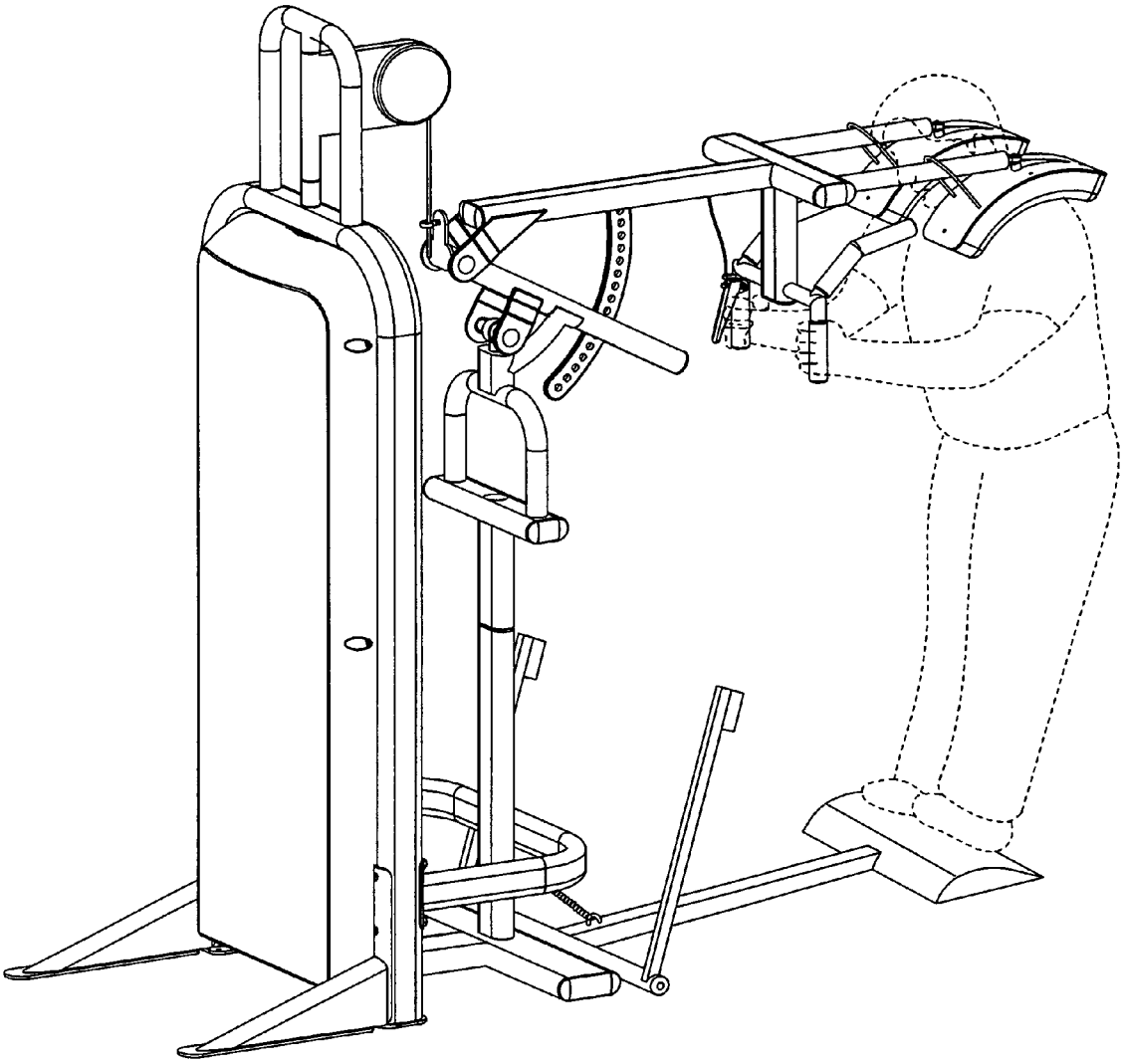
FIG. 12 is a perspective view illustrating exemplary use of an alternate embodiment of a change of direction machine with calf block extended.

The user may then perform one or more exercises. For example, the user may perform one or more squats or one or more enhanced squats, as will be described further below. In addition, it is contemplated that the user may perform one or more other exercises. For example, the user may perform calf extensions such as raising the heel end of one or both of the user's feet. In the alternate embodiment change of direction machine shown in FIGS. 8 and 9, weight stack 511 is connected to the connector bar 502 with cable 510 and provides resistance to movement. A calf block 512 is included, which can be raised when not in use (counterweights 513 can optionally be included to assist the user in raising or lowering the calf block 512). In use, the user can stand on calf block 512, as shown in FIG. 12. The user can then perform calf extensions by raising the heel of one or both of the user's feet.

Figure 13A:
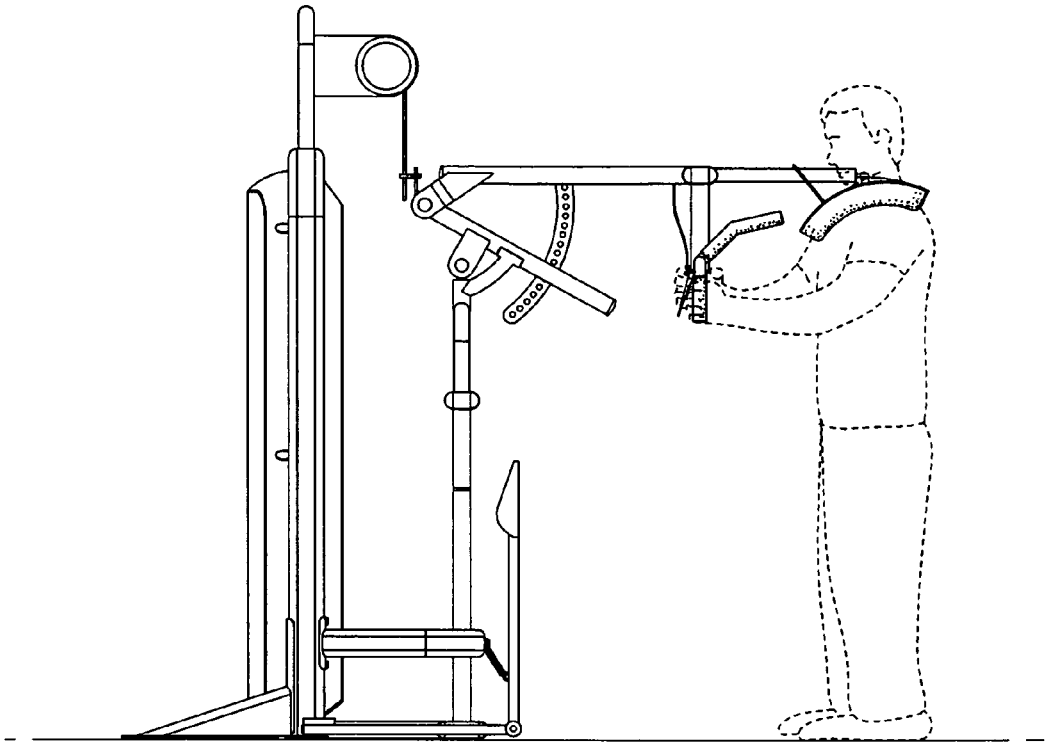
FIGS. 13A and 13B are side views illustrating exemplary use of an alternate embodiment of a change of direction machine.

To perform a squat, the user may start from an upright or standing position, such as shown in FIG. 5B (and in FIG. 13A of the alternative embodiment device). The user may then lower his or her body by bending at the knees and waist such as shown in FIG. 5C (and in FIG. 13B of the alternate embodiment device). As can be seen, the resistance provided by the arm assembly 108 applies a downward force on the user through the user's shoulders. Thus, when lowering his or her body, the user must also resist the force of the arm assembly 108. This helps strengthen and tone the user's muscles, in particular, the user's leg muscles and gluteal muscles. In addition, other surrounding body structures (e.g., bones, tendons, and ligaments) or body structures associated with this lowering of the user's body are strengthened and toned.

To complete the squat, the user may then raise his or her body back to an upright position, such as that shown in FIG. 5B and FIG. 13A. In moving upward to an upright position, the user must overcome the resistance applied by the arm assembly 108 through his or her shoulders. In this manner, the resistance enhances the training of the user's muscles during the upward motion. The upward motion strengthens and tones the user's muscles and body structures as described above.

As can be seen, the user need not grasp the arm assembly 108 during training. This is because the one or more pads 128, pivot 120, and downward force of the arm assembly 108 keep the arm assembly engaged to the user's shoulders, even if the user tilts his or her shoulders. This is beneficial because it frees the users hands for other purposes. For example, the user may utilize his or her arms and hands to stabilize his or her torso during training, such as by placing his or her hands at or near his or her waist. Of course, the user may grasp one or more handles of the arm assembly during training, if provided, and if desired, such as described above.

In contrast to weights which need to be held in the user's hands or balanced across the user's shoulders (e.g., across the user's trapezius muscle of the user's back), the arm assembly 108 remains engaged to the user without the use of the user's hands or the need for balancing. This is highly advantageous over weights in that it reduces the risk of injury, accidents, and the like. With weights the user must support and balance while lifting and lowering his or her body. This becomes increasingly difficult and increasingly dangerous as the user becomes fatigued from training, especially where the weights are substantial. In addition, with the change of direction machine, the user does not have to exert energy to hold or balance a weight. In this manner, the user's energy is focused on the desired training and not on holding or balancing weights.

Moreover, the arm assembly 108 provides a rigid structure which allows up and down motion and lateral motion during training, while keeping the user's upper body from moving forward or backward. For instance, arm assembly 108 and the pads 128 (or other portion of the engagement end 140) may "lock" a user's upper body in position such that the upper body does not move or rotate forward or backward. This prevents the user from becoming injured due to such motion in contrast to traditional squats where the weights and user's upper body are free to move forward or backward at the risk of injury.

It is contemplated that the arm assembly 108 may be blocked from moving below a certain point. Thus, if the user is unable to hold the arm assembly 108 the user may lower his or her shoulders/body downward to the lowest point of the arm assembly's range of motion. The weight of the arm assembly is then held by the change of direction machine's structure and the user may safely disengage the arm assembly. This is highly beneficial in that it reduces the risk of injury. With weights, the user would likely drop the weights potentially injuring him or herself and/or nearby bystanders. In fact, even if the user were to collapse the arm assembly 108 would not fall onto the user and potentially cause impact injuries.

One or more cross bars or other members attached to the support assembly may be provided to prevent the arm assembly's 108 from moving below a certain point. In one embodiment, a safety bar may be extend through an interior portion of the spring. As the arm assembly 108 moves downward it may contact the safety bar preventing further downward motion.

Figure 15A:
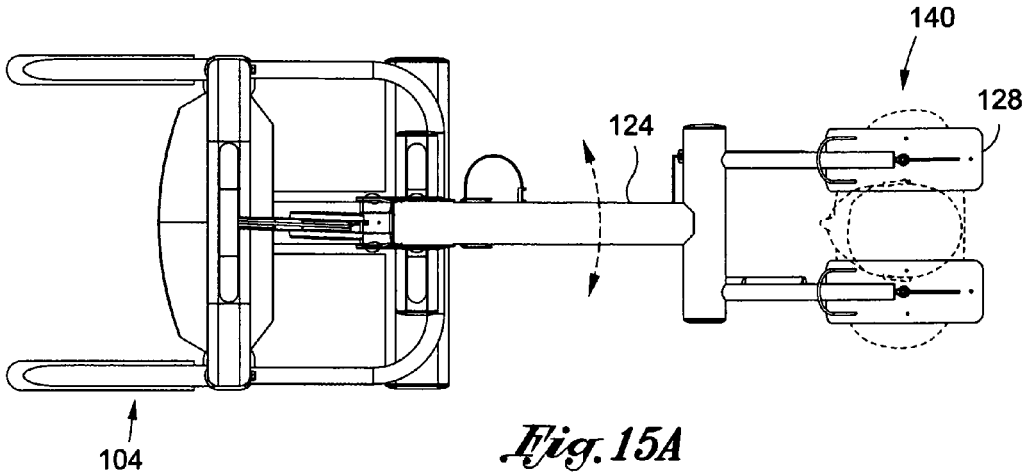
FIGS. 15A through 15C are top views illustrating exemplary use of an alternate embodiment of a change of direction machine.
Figure 15B:
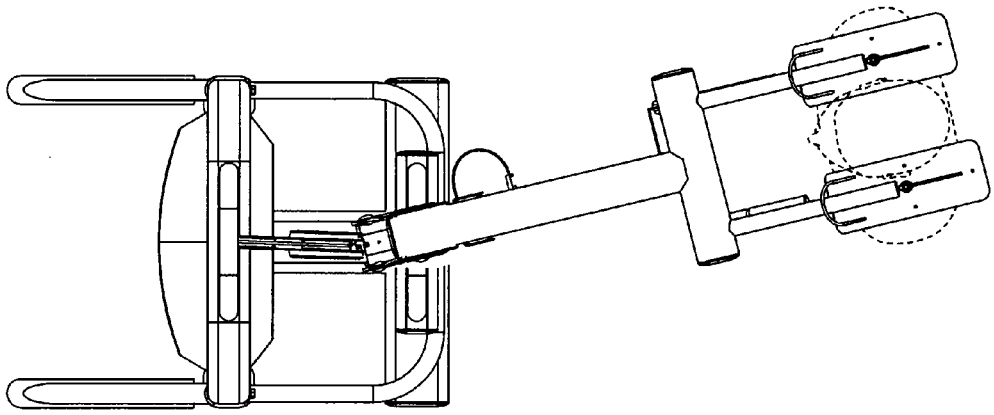
Figure 15C:
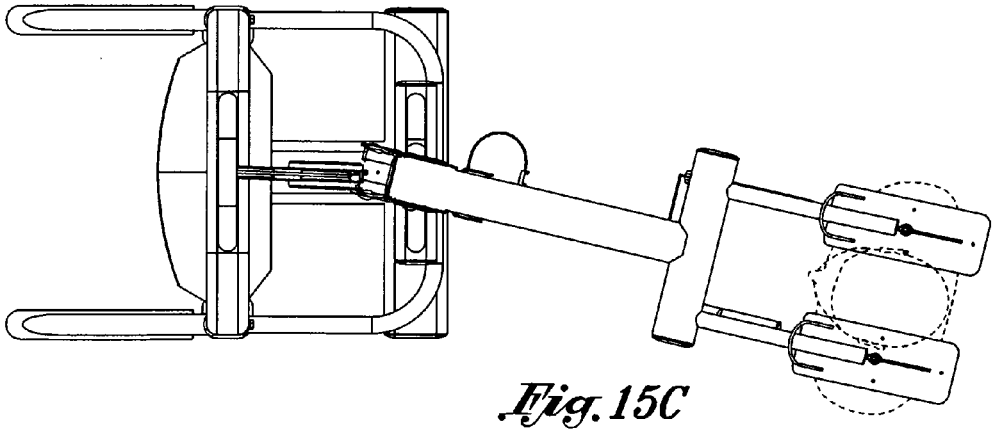

As stated, the arm assembly 108 has a wide range of motions which allows a variety of training to be performed with the change of direction machine. As shown in the overhead view of FIGS. 6A through 6C (and in FIGS. 15A through 15C of the alternate embodiment device), the arm assembly 108 may move in a horizontal direction instead of or in addition to the vertical motion illustrated in FIGS. 5A-5C and 13A-13B. It is contemplated that the user may exercise by moving laterally while engaged to the arm assembly 108. As can be seen from FIGS. 6A-6C and 15A-15C, the resistance from the arm assembly 108 continues to be applied to the user even as the arm assembly moves laterally. Thus, it is contemplated that the user may tone and strengthen his or her lower body and torso muscles simply by stepping or otherwise moving laterally while engaged to the arm assembly 108. This is because the user must support the resistance of the arm assembly 108 while moving.

Figure 11:
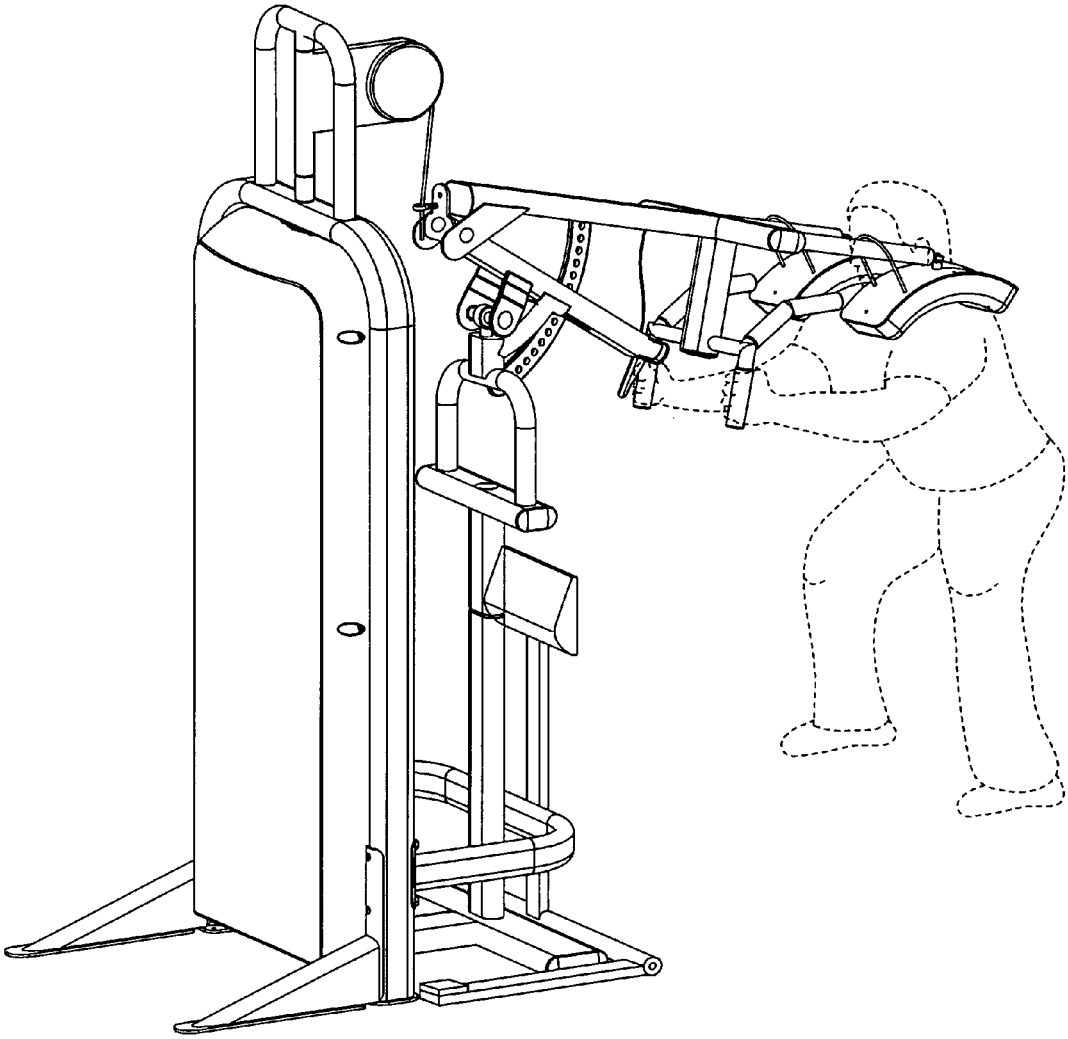
FIG. 11 is a perspective view illustrating exemplary use of an alternate embodiment of a change of direction machine.

One or more enhanced squats may be performed on the change of direction machine. In one or more embodiments, an enhanced squat may comprise a vertical motion and a horizontal motion performed by the user's body. For example, the user may lower and raise his or her body while moving in a lateral direction to perform an enhanced squat, as shown in FIG. 11, which depicts such movement using the alternate embodiment change of direction machine shown in FIGS. 8 and 9. This combined motion is highly beneficial because it strengthens and tones muscles and other body structures used in changing the direction of a user's body. For athletes and other users, the ability to quickly and powerfully stop and/or change the direction of one's body is highly advantageous. For instance, a tennis player may need to quickly move in one direction for a return and move in another direction for another return. In basketball, a player may need to quickly change directions to avoid or split defenses as well as to prevent quick players from scoring.

Of course, any user may benefit from such training. The muscles and body structures used to change directions (e.g. the muscles and structures along the sides of the user's body and the interior of the user's legs) are difficult to train. Traditional exercise devices lack a pivoting arm assembly 108 or the equivalent to allow this type of training. Use of free weights in this manner is exceedingly dangerous and requires the user to exert energy to hold and/or balance the weights. The change of direction machine allows exercises involving changes of direction and enhances the effectiveness of these exercises by applying a resistance to the user.

The pivoting arm assembly 108 provides a wide range of motion while the user is engaged to the arm assembly as can be seen from FIGS. 6A-6C and 15A-15C. This allows the user to move in a wide area around the change of direction machine while experiencing the resistance provided by the machine. This also allows training to be enhanced by the resistance applied to the user through the arm assembly 108. Thus, the user achieves results a great deal faster with the change of direction machine.

In fact, the user is able to achieve results that would otherwise be impossible. This is because the resistance provided by the arm assembly 108 is applied to the user across a wide range of movements around the change of direction machine. In other words, the change of direction machine and its pivoting arm assembly 108 provides a combination of resistance and range of motion that a user could not otherwise experience. In addition, as stated above, the resistance provided by the arm assembly 108 may be increased to a substantial amount, further enhancing the user's training with the change of direction machine.

An enhanced squat will now be described with regard to FIGS. 5A-5C and FIGS. 6A-6C, and FIGS. 13A-13B and FIGS. 15A-15C. The user may "step into" the change of direction machine as shown in FIG. 5A and engage the arm assembly 108 as shown in FIG. 5B. In one embodiment, the arm assembly 108 may be perpendicular to the support assembly 104 as this is occurring, such as shown in FIG. 6A. Of course, the arm assembly 108 may be at various angles. And, as already described in greater detail above, the user of the alternate embodiment device shown in FIGS. 8 and 9 may engage handle 506 to easily and readily adjust the height of arm assembly 108, after stepping into the alternate embodiment device, as shown in FIG. 13A.

Typically, the arm assembly 108 will be locked in position. Thus, the user may unlock the arm assembly 108 if applicable prior to training. As stated, this may occur by disengaging a coupler of an arm assembly's locking mechanism. Once unlocked, the arm assembly 108 may move freely in a vertical direction as well as in a horizontal direction.

Figure 13B:
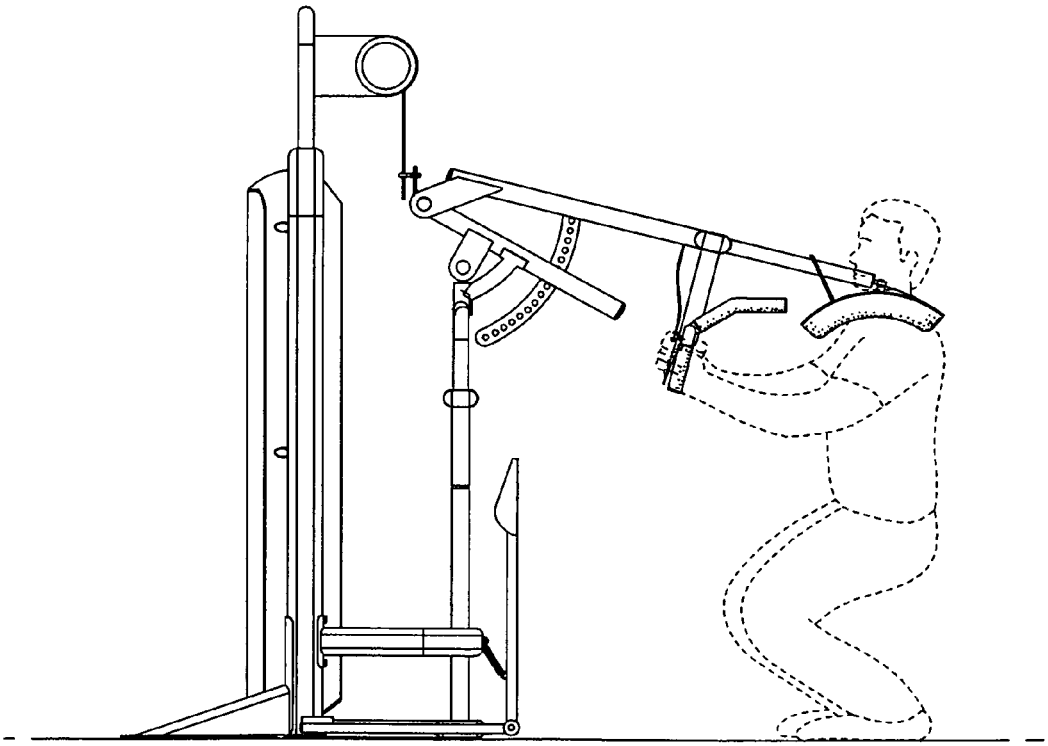

To begin an enhanced squat, the user may step laterally with one leg. The user may simultaneously lower his or her upper body by bending at the knees and hips, such as shown in FIG. 5C and FIG. 13B. For example, the user may take a rightward step with his or her right leg and lower his or her upper body to a squatting position. As the user lowers his or her body, the arm assembly 108 is moved downward, as shown in FIG. 5C (and in FIG. 11 with respect to the alternate embodiment device), and rightward as shown in FIG. 6C (and in FIGS. 11 and 15B). While in this "rightward" location, the user may then raise his or her body and the arm assembly, such as shown in FIG. 5B and FIG. 13A. The user may then move one leg towards his or her other leg to complete the lateral motion. In the above example, the user may move his or her left leg towards his or her right leg such that the user's feet are approximately shoulder width apart.

As can be seen the structure of the arm assembly 108 holds the user's upper body in position so that the upper body has limited forward and backward movement. As discussed, this greatly reduces the risk of injury when training, especially as compared to traditional apparatus and methods. The arm assembly's structure may position the user's upper body at a fixed distance away from the support structure 104. Thus, even though the user may raise and lower his or her upper body, move laterally, or do both, the user's upper body motion in a forward-backward direction is limited thereby increasing the user's safety.

Figure 6A:
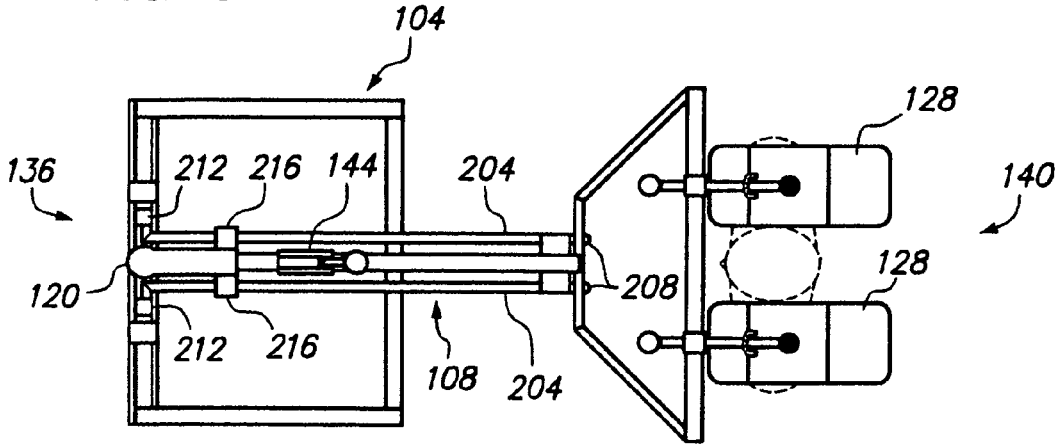
FIGS. 6A-6C are top views illustrating exemplary use of a change of direction machine.
Figure 6B:
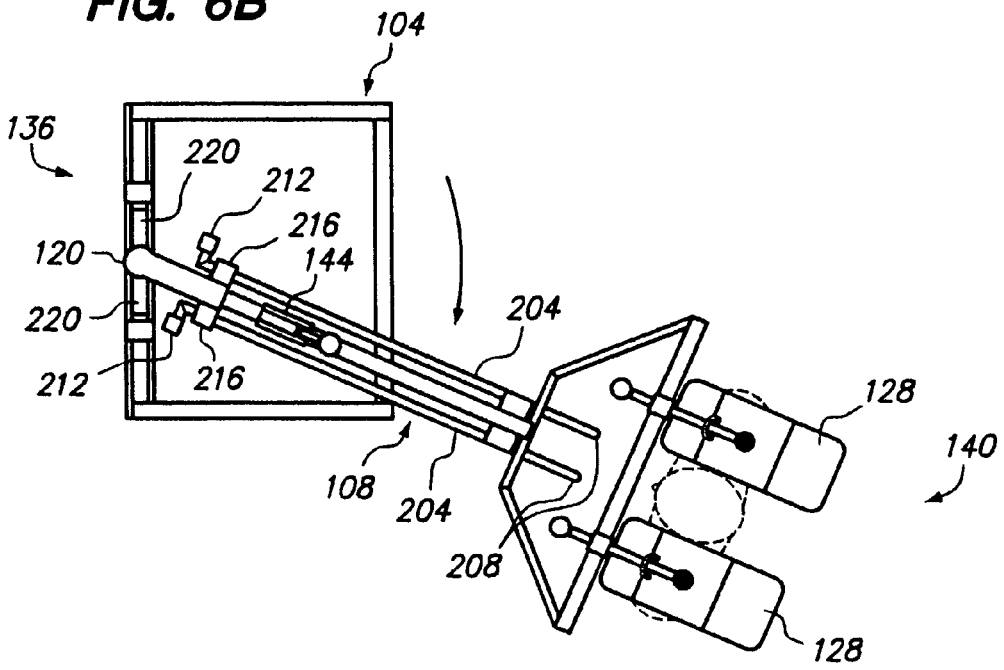

The user may then perform one or more squats or one or more additional enhanced squats. For example, the user may continue moving leftward as indicated by the arrow of FIG. 6B, or the user may move rightward if additional enhanced squats are desired. The user may also stay in the same location and perform squats. If the user desires to move leftward, he or she may repeat the motions described above. It is contemplated that the user may continue moving in one direction until the arm assembly 108 is parallel to the support assembly 104 (or beyond) in one or more embodiments. This allows motions in the same direction to be repeated several times before the user must move in another direction, which is advantageous to strengthening and toning the user's body for these motions.

Figure 5C:
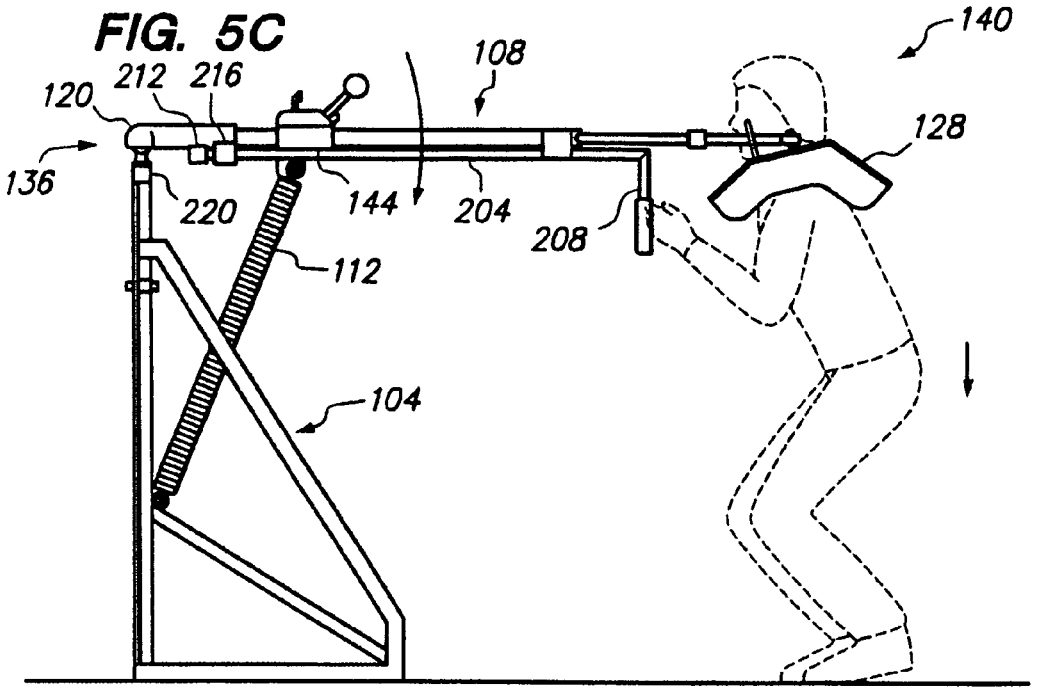
Figure 6C:
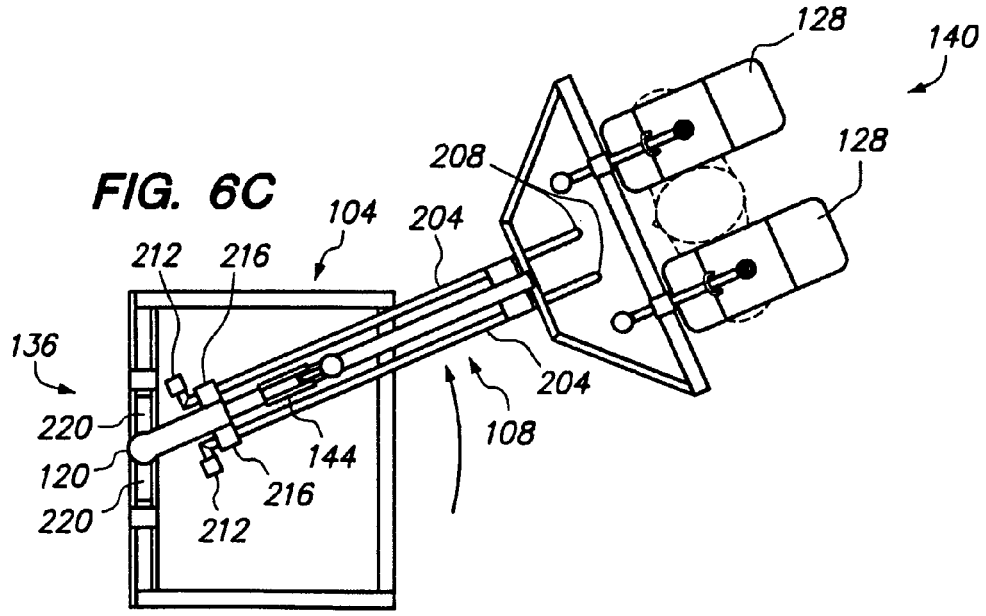

To move rightward, the user may begin from a position where his or her feet are adjacent, such as a shoulder's width apart and step with his or her right foot in a rightward direction while lowering his or her upper body, such as shown in FIG. 5C and FIG. 13B. This causes the arm assembly 108 to move rightward. For example, if the user is located at the position shown in FIG. 6B (or FIG. 15C in the alternate embodiment device), moving rightward may cause the arm assembly 108 to be moved back to the position in FIG. 6A or 15A. The user may then raise his or her upper body to the position shown in FIG. 5B and FIG. 10A. The user may continue moving rightward to the location shown in FIG. 6C (and FIGS. 11 and 15B), may stay in the same location, or may change direction and move leftward such as to the location shown in FIG. 6B or FIG. 15C. This may be repeated as desired.

It can thus be seen that the user may rapidly alternate between rightward and leftward motions to train the muscles and body structures involved in changing direction. Likewise, the user may also perform one or more repetitions in one direction and then alternate to another direction to train these muscles and body structures.

Figure 14A:
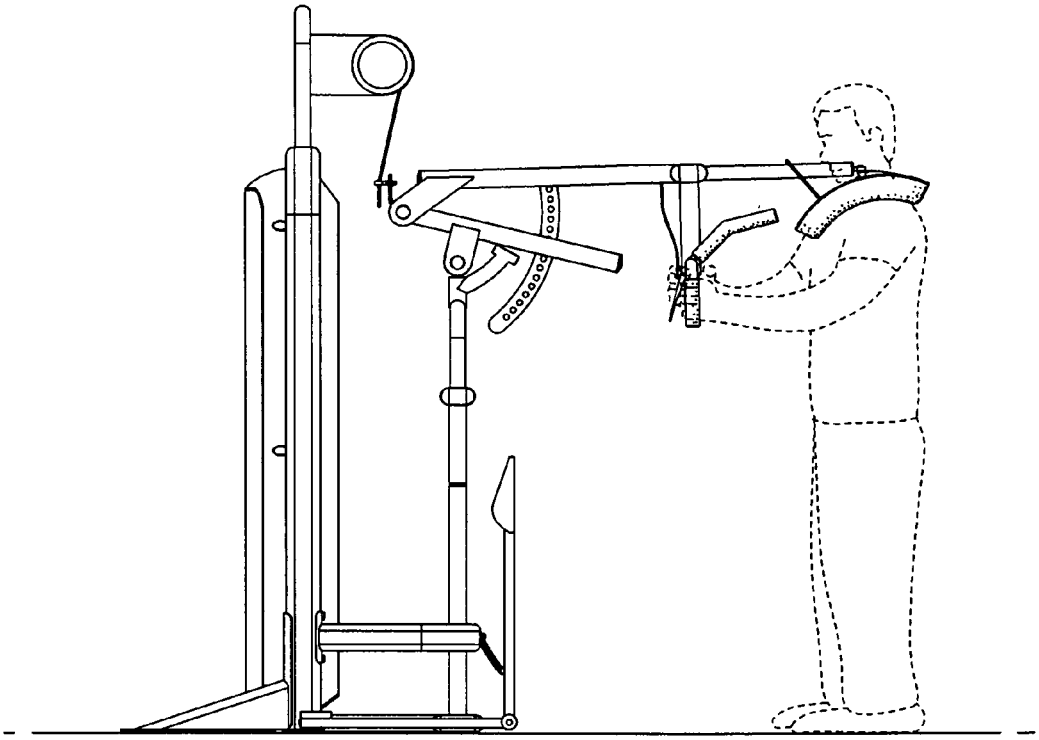
FIGS. 14A and 14B are side views illustrating exemplary use of an alternate embodiment of a change of direction machine.
Figure 14B:
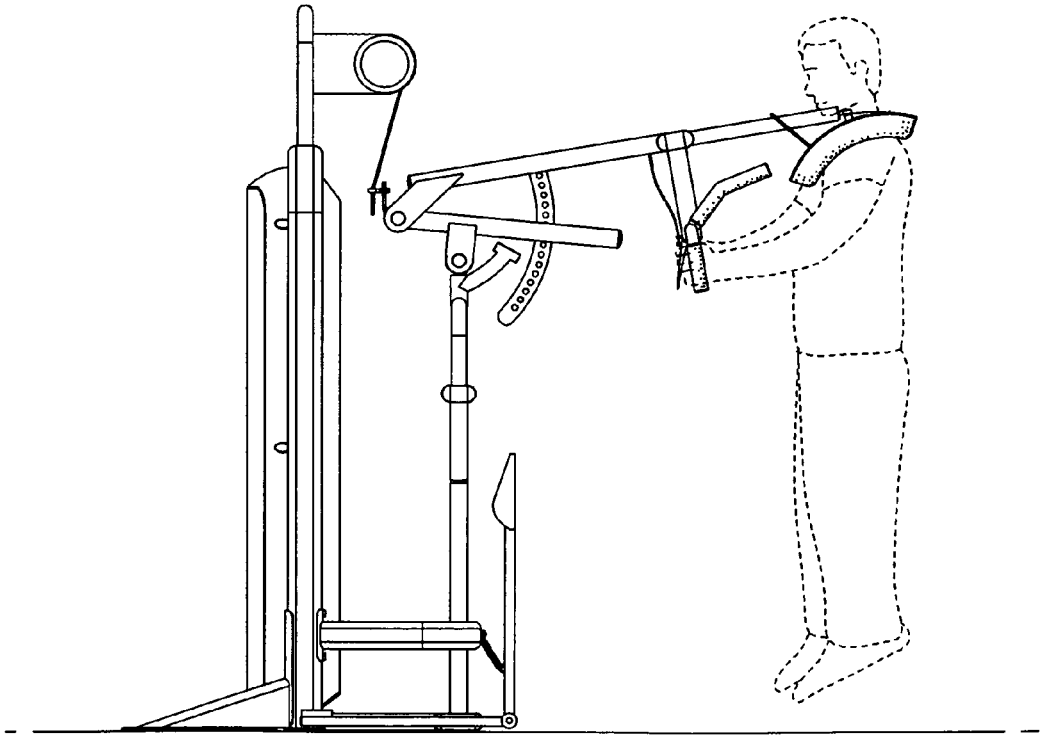

It is contemplated that the arm assembly 108 may be configured to rotate 360 degrees around the support assembly 104 in one or more embodiments. For example the resistance device, such as a spring or elastic band, may be mounted to a rotating mount on the support assembly 104. In this manner, the arm assembly 108 may be permitted to rotate 360 degrees around the support assembly 104 while continuing to provide resistance to the user. The user may then perform as many enhanced squats in a leftward or rightward direction as the user desires. The user also may engage in bounding or jumping exercises, as shown in FIGS. 14A and 14B, for example.

In addition to the leg muscles and gluteal muscles trained by squat-type exercises, the change of direction machine focuses training on specific muscles used in performing changes of direction. For example, muscles and body structures of the left and right sides of the user may be toned and strengthened. For instance, the inner and outer thigh muscles may be toned and strengthened as well as the user's side abdominal muscles. This is highly beneficial in that these muscles and associated body structures are typically difficult to tone and strengthen. In addition, the user's torso or core muscles and body structures may also be toned and strengthened in support the resistance of the arm assembly 108 while moving in a lateral direction.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. An exercise machine comprising:

an arm assembly having a cantilever and a connector bar, the cantilever having a first end and a second end, the first end of the cantilever being pivotally attached to the connector bar to define an fixedly variable angle between them, the second end of the cantilever being configured to engage one or more shoulders of a user;

a support structure is pivotally connected to the arm assembly about a vertical axis to provide vertical and horizontal movement of the arm assembly relative to the support structure, wherein the second end of the cantilever extends outward from the support structure; and, a resistance device having a first end and a second end, the first end connected to the arm assembly and the second end connected to the support structure;

wherein the arm assembly is capable of simultaneous horizontal and vertical movement relative to the support structure.

2. The exercise machine of claim 1 further comprising an adjuster bar attached to the arm assembly to fixedly vary the angle between the cantilever and the connector bar.

3. The exercise machine of claim 2 further comprising a handle attached to the second end of the cantilever, wherein activation of the handle will allow the angle to be varied and deactivation will fix the angle.

4. The exercise machine of claim 3 further comprising a cable communicating between the handle and the adjuster bar, wherein activation of the handle causes the cable to retract a pin from the adjuster bar.

5. The exercise machine of claim 4 further comprising one or more range limiters at the second end of the arm assembly, the one or more range limiters configured to prevent lateral movement of one or more pads, wherein the one or more pads are rotatably mounted to the arm assembly at the engagement end.

6. The exercise machine of claim 1 further comprising a calf block.

7. The exercise machine of claim 1 wherein the second end of the resistance device is connected to a weight stack in the support structure.

8. An exercise machine comprising:

an arm having a first end and one or more user engagement pads on a second end;

a connector bar pivotally attached to the first end of the arm to provide vertical movement of the arm relative to the connector bar about the pivotal attachment;

a support structure configured to stabilize the exercise machine, wherein the support structure is pivotally connected about a vertical axis to the connector bar to provide vertical and lateral movement of the connector bar relative to the support structure, and wherein the arm extends outward from the support structure;

a resistance device connected to the connector bar to provide resistance against upward vertical movement of the second end of the arm;

wherein the arm is held at an elevated position by the support structure and the second end of the arm is moveable laterally and vertically relative to the support structure; and wherein the angular position of the arm relative to the connector bar can be fixedly adjusted.

9. The exercise machine of claim 8 wherein the resistance device has a first end and a second end, the first end attached to the connector bar and the second end attached to a weight stack in the support structure.

10. The exercise machine of claim 9 wherein at least one of the user engagement pads further comprises a pivot which allow a user engagement pad to pivot relative to a user and engage an upper body of the user.

11. The exercise machine of claim 10 further comprising one or more rotating pads at the second end of the arm, the one or more rotating pads configured to engage the upper body of the user, wherein the one or more rotating pads are limited from rotating laterally.

12. The exercise machine of claim 8 further comprising a handle configured to unlock the arm in angular position relative to the connector bar when engaged and to lock the relative angular position when the handle is disengaged.

13. The exercise machine of claim 8 further comprising a calf block.

14. A method of training a user on a change of direction machine, the method comprising:

engaging an engagement end of a pivoting arm at a portion of the user's upper body, the pivoting arm configured to provide resistance to the upper body in a downward direction, the pivoting arm coupled to and extending outward from a support structure of the change of direction machine, wherein the pivoting arm is held at an elevated position by the support structure and the pivoting arm is capable of simultaneous movement relative to the support structure laterally and vertically, wherein the pivoting arm is connected to the support structure by a connector bar that is pivotally connected to the support structure, and wherein the elevated position is fixedly adjustable by varying the position of the pivoting arm to the connector bar;

lowering the upper body to a lowered position by bending at the knees while resisting the resistance applied to the upper body without moving the upper body in a forward or backward direction, wherein lowering the upper body rotates the pivoting arm in a vertical direction;

raising the upper body to a raised position by extending at the knees and waist to overcome the resistance applied to the upper body without moving upper body in a forward or backward direction, wherein raising the upper body rotates the pivoting arm in a vertical direction;

taking a step with a first foot in a lateral direction; and moving in the lateral direction while lowering the upper body, wherein moving in the lateral direction rotates the pivoting arm in a lateral direction.

15. The method of claim 14 further comprising moving laterally while raising the upper body, wherein moving laterally rotates the pivoting arm in a lateral direction.

16. The method of claim 14 further comprising moving a second foot towards the first foot such that the first foot and second foot are adjacent.

17. The method of claim 14 further comprising:

moving laterally in a first direction while lowering the upper body one or more times; and moving laterally in a second direction while lowering the upper body one or more additional times;

wherein moving laterally in the first direction and moving laterally in the second direction rotates the pivoting arm in a first lateral direction and a second lateral direction.

18. The method of claim 14 further comprising disengaging a locking mechanism of the pivoting arm to unlock the pivoting arm relative to the connector bar.

19. The method of claim 14 further comprising adjusting the resistance applied to the upper body by changing the amount of weight on a weight stack.

20. The method of claim 14 wherein the user steps on a calf block.

* * * * *